US006666048B1

(12) United States Patent
Brugerolle et al.

(10) Patent No.: US 6,666,048 B1
(45) Date of Patent: Dec. 23, 2003

(54) VARIABLE CAPACITY FLUID MIXTURE SEPARATION APPARATUS AND PROCESS

(75) Inventors: Jean-Renaud Brugerolle, Paris (FR); Alain Guillard, Paris (FR); Bernard Saulnier, Colombes (FR); Patrick Le Bot, Vincennes (FR); Jean-Marc Tsevery, Lieusaint (FR); Alain Fossier, Sceaux (FR); Jean-Luc Bretesche, Saint-Maur (FR); Bernard Darredeau, Sartrouville (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/958,145

(22) PCT Filed: Apr. 5, 2000

(86) PCT No.: PCT/IB00/00412

§ 371 (c)(1),
(2), (4) Date: Jan. 15, 2002

(87) PCT Pub. No.: WO00/60294

PCT Pub. Date: Oct. 12, 2000

(30) Foreign Application Priority Data

Dec. 2, 1999 (FR) ..... 99 15208

(51) Int. Cl.[7] ..... F25J 3/04
(52) U.S. Cl. ..... 62/644
(58) Field of Search ..... 62/615, 617, 640, 62/643, 644, 645

(56) References Cited

U.S. PATENT DOCUMENTS 4,818,262 A 4/1989 Brugerolle
4,848,996 A 7/1989 Roden et al.
5,049,173 A * 9/1991 Cormier, Sr. et al. ..... 62/24
5,896,755 A 4/1999 Bonaquist et al.
5,901,576 A * 5/1999 Agrawal et al. ..... 62/646
6,202,442 B1 * 3/2001 Brugerolle ..... 62/649

FOREIGN PATENT DOCUMENTS

JP 03 050483 A 3/1991
JP 11 325718 a 11/1999

OTHER PUBLICATIONS

"Process and Facility with Particularly High Availability," Research Disclosure, GB, Industrial Opportunities Ltd. Havant, No. 397, 1997, pp. 276–279.

* cited by examiner

*Primary Examiner*—Henry Bennett
*Assistant Examiner*—Malik N. Drake
(74) *Attorney, Agent, or Firm*—Young & Thompson

(57) ABSTRACT

In order to boost production of a product (A) of an existing separation plant (X, 1), an additional plant (Y) is integrated with the original plant so as to enable the original plant (X) to produce more of that product (A+B), whilst the additional plant may or may not necessarily itself produce the same product directly. For example, air is separated in a first unit, which is an existing double column distillation plant, to produce an oxygen rich fluid. So as to increase the production of the oxygen rich fluid, a second unit, which is a wash column (15), is integrated with the first unit. Air (41) is separated in the single nitrogen wash column (15) to remove oxygen and gaseous nirogen (42) is produced at the top of the column. The wash column is fed with liquid nitrogen (39) from the high pressure column (25) of an existing air separation unit.

78 Claims, 16 Drawing Sheets

X
1
14
5
45
23
21
47
9
25
26
7
37
27
29
41
17
3
19
13
15

X
2
38
142
140
138
133
130
128
125
132
136
34
41
42
32
25
29
27
36
43
28
33
30

VARIABLE CAPACITY FLUID MIXTURE SEPARATION APPARATUS AND PROCESS

TECHNICAL FIELD OF THE INVENTION

The present invention relates to a process for increasing the capacity of a separation apparatus and an air separation process and apparatus.

BACKGROUND OF THE INVENTION

Industrial plants frequently treat at least one gaseous mixture by distillation and/or liquefaction and/or adsorption and/or permeation to produce at least one product which may include energy in the form of electricity or steam or a gaseous or liquid product having a composition or state different from that of one of the gaseous mixtures treated.

Generally when the product requirement increases, in a first phase, the capacity of the plant is pushed to the limit by increasing the amount of mixture treated and, if necessary, changing the plant equipment to permit this increase. Once the maximum capacity of the existing plant is not sufficient, a second phase is initiated and a further similar plant is constructed to supply the additional requirements, by itself producing part of the required product.

For example, in many cases, an air separation plant must supply variable amounts of gas and liquid over its lifetime. If the amount of product required increases, in the first phase, the air separation plant can be operated at maximum capacity as disclosed in EP-A-0678317 to increase the amount of air sent to the column.

Additionally different products may be required during the lifetime of the plant. For example, the purity required for a supplied gas may change or a gas not initially needed may subsequently be requested. Thus as described in U.S. Pat. No. 4,869,742 and EP-A-0699884 (S3901), additional trays may be placed within the column of an existing plant or a new column may be added to an existing plant as a retrofit so as to provide a new product. In the examples of EP-A-0081472 and U.S. Pat. Nos. 4,433,990 and 4,715,874 a plant which produces only oxygen is modified to produce argon also.

GB-A-1416163 and J-A-11325718 disclose modifying an existing plant by increasing the oxygen content of the air fed to the separation unit, using a membrane or a PSA.

Research Disclosure 39361 (January 1997) describes the integration of a mixing column into an existing air separation plant.

U.S. Pat. No. 5,170,630 discloses improving the purity of nitrogen produced by a plant by modifying the condenser and column and adding a phase separation tank and associated piping.

EP-A-0628778 describes an air separation plant in which liquid oxygen from a column of the plant and liquid oxygen from an external source are mixed and vaporized in the heat exchanger of the air separation plant.

In particular, the apparatus and process of the invention allows the capacity of an existing air separation unit to be increased beyond the limits of previously known systems.

It is known for an air separation apparatus to comprise a double column and a further column fed by air. In such cases the further column is commonly a mixing column fed by an oxygen rich liquid at the top of the column as disclosed in U.S. Pat. Nos. 4,022,030, 4,883,517, 5,244,489, 5,291,737 and EP732556.

Nitrogen stripping columns are also known from EP387872, EP532155 and EP542559. In none of these cases is an air stream fed to the column.

It is an object of the present invention to minimize the cost of the second phase by using an additional plant which may or may not directly produce any of the additional product required but which is linked to the existing plant by exchanges of matter and /or energy so that the existing plant can produce the additional quantity of product required as well as new products, in some cases.

Thus the aim of the invention is to increase the amount of a first product of an installation comprising a first existing unit only from A mol. /h before modification to Cmol/h following modification, the production of the first unit being boosted to A+B mol./h, A+B being less than or equal to C and of course greater than A.

The modification consists in incorporating in the installation a second unit and sending energy and/or matter either from the first unit to the second unit or from the second unit to the first unit such that the production of the first unit is boosted to A+B.

In certain cases, where A+B is smaller than C, the difference B' mol./h may be produced directly by the second unit and mixed with A+B from the first unit to produce C om the whole installation.

The pressure of the first product in amount A and amount C may vary by up to 5 bars.

The temperature of the first product in amount A and amount C may vary by up to 25° C., or preferably 5° C.

It will generally be the case that the total amount of feed in mol./h sent to the existing first unit before modification will be less than the total amount of feed sent to the first unit (or to the first and second units if feed is sent to both).

SUMMARY OF THE INVENTION

According to a first embodiment of the invention, there is provided a process for increasing the amount of at least one product produced by a first unit for treating at least one fluid mixture by at least one of the group of processes comprising pressurization, expansion, distillation, mixing in a mixing column, liquefaction, adsorption and permeation wherein at least one fluid mixture is sent to the first unit and at least one product is removed from the first unit, said product having a different composition from said at least one fluid mixture and optionally a different state and/or a different pressure from said at least one fluid mixture, wherein the first unit alone before integrating a second unit to the first unit produces an amount A moles/h of a first product and said amount of first product withdrawn from the first unit and optionally from the second unit is increased to C moles/h, C being greater than A, and the amount C comprising at least one fluid stream withdrawn from the first unit and optionally from the second unit, by integrating the second unit with the first unit, said integration comprising sending energy and/or at least one fluid from the first unit to a second unit and/or from the second unit to the first unit, wherein said second unit treats at least one fluid mixture by at least one of the group of processes comprising pressurization, expansion, warming, cooling, distillation, mixing in a mixing column, liquefaction, adsorption and permeation such that the first unit produces an amount of first product A+B moles/h.

The first unit comprises means for carrying out at least one of the group of processes comprising pressurization, expansion, distillation, mixing in a mixing column, liquefaction, adsorption and permeation. It may also include other means such as pretreatment means for cooling and/or purifying and/or compressing, storage means or insulation means, for example a cold box.

The second unit comprises means for carrying out at least one of the group of processes comprising pressurization, expansion, warming, cooling, distillation, mixing in a mixing column, liquefaction, adsorption and permeation. It may also include other means such as pretreatment means for cooling and/or purifying and/or compressing, storage means or insulation means, for example a cold box.

The amount of first product may be increased such that A+B is less than or equal to C.

Where A+B is less than C, the difference between C and A+B is an amount of product B' moles/h produced by the second unit.

The compositions of the first product before and after integration need not be strictly identical: for example the percentage of principal component in the first product in amount A and amount C may differ by up to 5 mol. %, up to 1 mol. % or up to 0.2 mol. %.

Similarly the composition of the first product produced by the first and second units, before or after integration need not be strictly identical: for example the percentage of principal component in the first product in amount A and amount B' may differ by up to 10 mol. % or up to 5 mol. % or up to 2 mol. %

In some cases, the second unit treats a mixture having substantially the same composition as the mixture treated by the first unit.

In some cases the second unit produces a second product having a percentage of principal component differing by 1 to 50% from the percentage of the first product of the first unit forming part of amount A+B or having a different principal component and/or state and/or pressure from the first product of the first unit forming part of amount A+B.(FIG. 2)

Generally, the amount of feed in moles sent to the first unit for the production of amount A only is less than the amount of feed in moles sent to the first unit for the production of amount C.

Where the second unit produces part of increased amount C, the amount of feed in moles sent to the first unit for the production of amount A only may be less than the amount of feed in moles sent to the first and second units for the production of amount C.

In general, the proportional increase in amount of feed in moles sent to the first unit for the production of amount C following the addition of the second unit as compared with the production of amount of feed in moles sent to the first unit for the production of amount A prior to the addition of the second unit may be less than, equal to or greater than the proportional increase between amount C and amount A.

The fluid mixture treated by the first and second units may for example be substantially air and the first product may contain at least 70 mol. % oxygen or at least 90 mol. % nitrogen or at least 90 mol. % argon.

In other cases, the fluid mixture treated may be a mixture comprising at least 1 mol. % nitrogen and/or at least 1 mol. % hydrogen and/or at least 1 mol. % carbon monoxide and/or at least 1 mol. % methane and the first product may contain at least 90 mol. % nitrogen or at least 90 mol. % hydrogen or at least 90 mol. % carbon monoxide or at least 90 mol. % methane.

In some cases the second unit does not treat the same mixture as the first unit.

In preferred embodiments, the first and/or second units may treat the mixture or mixtures by cryogenic distillation and/or liquefaction.

The first product may be removed from the first unit in gaseous form and/or at least one liquid may be removed from a column of the first unit and is vaporized to form the first product and then withdrawn from the first unit in gaseous form to form all or part of the rest of the gaseous first product.

Preferably the second unit modifies the composition of at least one fluid mixture fed thereto, for example by separating it (or mixing them) to form at least two fluids, each of which is enriched in one of the components of the fluid mixture.

Optionally the second unit produces at least one product having a different composition or pressure to the first product produced by the first unit and/or at least one product of the second unit is not mixed with the first product of the first unit which is to be produced in increased quantities.

In preferred embodiments, following integration of the second unit at least one fluid from the second unit is sent to the first unit as a feed stream to be separated and/or treated within the first unit.

Preferably at least one fluid sent from the second unit to the first unit is richer in the principal component of the first product than the fluid mixture sent to the first and/or second unit or than the first product.

In this case, the fluid sent from the second unit to the first unit may be richer in the principal component of the first product than the fluid mixture sent to the first and/or second unit but less rich in the principal component of the first product than the first product.

Preferably, following integration of the second unit, at least one fluid from the first unit is sent to the second unit as a feed stream to be separated, mixed and/or treated (e.g. heated or cooled) within the second unit.

In some cases the fluid sent from to the first unit to the second unit is less rich in the principal component of the first product than the fluid mixture sent to the first and/or second unit or than the first product and in particular cases the fluid from the second unit is richer in the principal component of the first product than the fluid mixture sent to the first or second unit but less rich in the principal component of the first product than the first product.

Preferably, following integration of the second unit, at least one fluid is removed from the first unit which is less rich in the principal component of the first product than the at least one fluid sent from the second unit to the first unit.

The at least one fluid sent from the second unit to the first unit contains at least 10 mol. % less, preferably at least 25 mol. % less or even at least 50 mol. % less, of the principal component of the first product than the at least one product removed from the first unit.

In one embodiment, following integration of the second unit a fluid from the second unit is sent to the first unit and is used to provide additional reboil in the first unit.

Alternatively or additionally following integration of the second unit, a fluid from the second unit is sent to the first unit and is used to provide additional condensation in the first unit.

The second unit need not produce a product.

The second unit may produce energy and the first unit need not produce energy.

Preferably the first unit produces part A+B of the at least one first product stream and the second unit produces the rest B' of the at least one first product stream, the parts of the at least one first product stream having a common principal component and the pressures of the part of the first product streams having a common principal component differ by at least 0.5 bar and/or 20% of the pressure of the higher pressure stream.

Additionally the first unit produces part A+B of the at least one first product stream and the second unit produces the rest of the at least one first product stream, the part s of the at least one first product stream having a common principal component and the parts of the first product streams having a common principal component are in different physical states.

The first unit may produce at least one first product stream and the second unit may produce at least one second product stream and the second product streams do not have the same principal component.

Preferably the amount of fluid sent from the first unit to the second unit in moles/h is substantially equal to the amount of fluid sent from the second unit to the first unit in moles/h or differs from that amount by no more than 50%, preferably by no more than 30% or even 10%.

Preferably where fluids are transferred from the second to the first unit and vice versa, either both or all the fluids are liquids or either both or all the fluids are gases.

Preferably the amount of fluid sent from the first unit to the second unit in m3/h is substantially equal to the amount of fluid sent from the second unit to the first unit in m3/h or differs from that amount by no more than 50%, preferably by no more than 30% or even 10%.

According to a preferred embodiment, the first unit is an air separation unit producing at least one fluid enriched in a component, wherein air is sent to the first unit and at least one fluid enriched in a component of air is removed from the first unit as a first product, an amount A moles/h of the first product being removed prior to the integration of a second unit and by sending energy or fluid from the first unit to the second unit and/or from the second unit to the first unit, the amount of first product which is produced by the first unit increases to A+B moles/h, wherein said second unit treats at least one gaseous mixture containing oxygen and nitrogen by at least one of the group of processes comprising distillation, mixing in a mixing column, liquefaction, adsorption and permeation such that the amount of fluid enriched in a component of air produced by the first unit and optionally by the second unit as said first product is increased to C moles/h, where C is greater than A. (FIGS. 2,4,5 and 6)

In this case, optionally, the first unit produces at least one first product stream and the second unit produces at least one second product stream and at least one second product streams has the same principal component as the at least one first product stream but the percentage of principal component contained in the first and second product streams having a common principal component differs by at least 5 mol.-% where the common principal component is oxygen or argon or the amount of minor components differs by at most a factor of 10 where the common principal component is nitrogen.

Preferably the percentage of principal component contained in the first and second product streams having a common principal component differs by at least 10 mol.-% or at least 20 mol.-% where the common principal component is oxygen or argon.

Preferably, the amounts of first product A and C or A and A+B have the same principal component and the amount of principal component differs between amounts A and C (or A and A+B) by at least 0.2 mol. %, preferably at least 1 mol. % or the amount of minor components differs by a factor of at most 1.2, preferably 2 where the principal component is oxygen or argon.

Attentively the amounts of first product A and C or A and A+B have the same principal component which is nitrogen and the amount of minor components in moles in A and C (or A and A+B) differs by at least a multiple of 10.

Preferably the amounts of first product A and C or A and A+B have the same principal component and the amount of principal component in product C (or A+B) is less than, greater than or equal to the amount of principal component in A.

In some cases, the fluid or fluids sent from the second unit to the first unit is(are) removed from the second unit at a subambient temperature and is (are) supplied to the first unit at a subambient temperature and/or wherein the fluid or fluids sent from the first unit to the second unit is (are) removed from the first unit at a subambient temperature and is (are) supplied to the second unit at a subambient temperature.

Alternatively the fluid or fluids sent from the second unit to the first unit is(are) removed from the second unit at a cryogenic temperature and is (are) supplied to the first unit at a cryogenic temperature and/or wherein the fluid or fluids sent from the first unit to the second unit is (are) removed from the first unit at a cryogenic temperature and is (are) supplied to the second unit at a cryogenic temperature.

The fluid or fluids sent from the second unit to the first unit may be removed from the second unit at any temperature and may be supplied to the first unit at any temperature and/or the fluid or fluids sent from the first unit to the second unit may be removed from the first unit at any temperature and may be supplied to the second unit at any temperature.

Preferably in the process for increasing the amount of fluid enriched in a component of air produced by a first existing air separation unit for treating air by distillation from A mol./h to produce C mol./h wherein air is sent to the first unit and at least one fluid enriched in oxygen is removed from the first unit as a product and by sending the fluid enriched in oxygen from a second unit to the first unit the amount of first product produced by the second unit being increased to A+B mol./h, wherein said second unit treats a gaseous mixture by at least one of the group of processes comprising pressurization, expansion, warming, cooling, distillation, mixing in a mixing column, liquefaction, adsorption and permeation such that the amount of fluid enriched in oxygen produced by the first unit is increased.

The second unit may be a single column cryogenic distillation unit fed by cooled and purified air and the oxygen enriched fluid is derived from the bottom of the column and contains between 25 and 45 mol. % oxygen.

Alternatively the first unit comprises at least a high pressure column and a low pressure column and air is fed at least to the high pressure column and the oxygen enriched fluid from the second unit is fed to the first unit, wherein it is separated, mixed and/or treated.

In this case, the sole product of the second unit may be a nitrogen enriched fluid.

Preferably a fluid enriched in nitrogen is sent from the first unit to a heat exchanger of the second unit and is warmed therein.

Preferably liquid enriched in nitrogen (140) is sent from the second unit (125, 130, 133) to the first unit to serve as reflux.

Preferably oxygen enriched liquid from the first unit is vaporized in the second unit, specifically in the heat exchanger of the second unit.

In one embodiment the process comprises sending compressed and cooled air to at least one first distillation column of a first air separation unit comprising at least one column and removing oxygen enriched fluid and nitrogen enriched fluid from the first unit and sending compressed and cooled air to a second unit comprising a single distillation column having a top condenser, condensing nitrogen enriched gas at the top of the single column of the second unit in the condenser, removing nitrogen enriched fluid from the second unit, optionally following an expansion step of at least part thereof, removing oxygen enriched liquid from the column of the second unit and sending it to the condenser to form vaporized oxygen enriched liquid, optionally following a distillation step and sending vaporized and/or unvaporized oxygen enriched liquid to a column of the first air separation unit and withdrawing oxygen enriched fluid at least from the first air separation unit as a product.

The air separation unit may comprise at least two distillation columns and said first distillation column is the column operating at the higher or highest pressure and the oxygen enriched product is removed from a column operating at a lower or the same pressure.

Optional features include:

sending said vaporized and/or unvaporized oxygen enriched liquid from the second unit to the first unit to be distilled and/or treated.

sending said vaporized and/or unvaporized oxygen enriched liquid to another column of the air separation unit.

sending said unvaporized oxygen enriched liquid to at least the first distillation column of the first unit.

sending said unvaporized oxygen enriched liquid to another column of the air separation unit.

sending said vaporized oxygen enriched liquid to the condenser of an argon column, to a low pressure column or to a mixing column.

the air sent to the second unit is at a higher pressure than, a lower pressure than or an equal pressure to any air stream sent to the first unit.

removing product nitrogen from the second unit.

expanding at least part of the nitrogen enriched gas removed from the second column in a turbine.

Another process for increasing the capacity of a first air separation unit in which a first air stream is separated by cryogenic distillation in a first air separation unit from which an oxygen enriched fluid is removed comprising adding a second unit to the existing first unit, sending a second air stream air to the bottom of a column of the second unit sending a nitrogen enriched liquid stream from the first air separation unit to the top of the column of the second unit, removing a gaseous nitrogen stream from the top of the column of the second unit, sending an oxygen enriched liquid stream from the column of the second unit to the first unit and removing an increased amount of the oxygen enriched fluid from the first unit.

Optional features of this process include:

said column of the second unit is a single column having no bottom reboiler and no top condenser.

sending air from a second compressor to the second unit and optionally to the first unit.

pressurizing or expanding the nitrogen enriched liquid from the first unit, and sending it to the top of the column of the second unit.

the column of the second unit operates at between 1.2 and 25 bar, preferably above 4.5 bar, still more preferably above 9 bar.

the pressure of the higher or highest pressure column of the first unit is between 4 and 25 bar.

the oxygen enriched liquid at the bottom of the column of the second unit contains between 25 and 50 mol. % oxygen, preferably between 30% and 40% oxygen.

the first air separation unit comprises at least one double column comprising a high pressure column and a low pressure column and the nitrogen enriched liquid comes from the high pressure column and/or the low pressure column.

sending the fluid from the bottom of the column of the second unit to the bottom of the high pressure column or to the low pressure column.

removing a first product stream containing at least 80 mol. % oxygen from the low pressure column of the first unit.

the first air separation unit is a triple column comprising a high pressure column, an intermediate pressure column and a low pressure column and the nitrogen enriched liquid is sent from the high pressure column or the intermediate pressure column to the second unit.

sending the fluid from the bottom of the column of the second unit to the high pressure column or the intermediate pressure column or to the low pressure column.

removing a first product stream containing at least 80% oxygen from the low pressure column of the first unit.

In another embodiment, there is provided a process wherein an existing air separation unit produces an amount A of an oxygen enriched product stream as first product, a second unit comprising a mixing column is integrated with the first unit and, subsequently, oxygen enriched liquid is sent from the first unit to the top of the mixing column, a gas more volatile than the oxygen enriched liquid is sent to the bottom of the mixing column and a fluid enriched in oxygen is sent from the mixing column to the first unit.(FIGS. 4 and 5)

The mixing column operates at a cryogenic temperature. Optionally:

the fluid enriched in oxygen sent from the mixing column to the first unit is a heating stream for a vaporizer-condenser of a column of the first unit.

the fluid enriched in oxygen is sent to a column of the first unit, preferably to a low pressure column of a double column, as a feed stream preferably following at least partial condensation in a vaporizer-condenser of the low pressure column.

the gas more volatile than the oxygen enriched liquid is air or vaporized oxygen enriched liquid from the bottom of the high pressure column of the double column which constitutes the first unit.

According to another embodiment, there is provided an air separation apparatus having a first unit comprising at least a high pressure column and a low pressure column and possibly an intermediate pressure column which are thermally linked, a second unit comprising means for cryogenic distillation of air, means for removing a stream containing more than 20 mol % oxygen from a column of the second unit, means for sending the stream containing more than 20 mol. % oxygen to the high and/or intermediate and/or low pressure column, means for sending cooled and purified air at least to the high pressure column and to the second unit and means for removing an oxygen enriched product stream fromat least one unit.

Optional features of this embodiment include:

a second unit comprising a single column having a top condenser, means for feeding cooled and purified air to the single column, means for sending a bottom liquid from the bottom of the column to the top condenser and wherein the means for producing a stream containing more than 20 mol. % oxygen links the top condenser and/or the single column with a column of the first unit.

means for removing at least a nitrogen enriched fluid from the single column.

conduit means links the top condenser of the second unit so as to remove a liquid and a gas containing at least 20 mol. % oxygen therefrom and is connected to the high pressure column and/ the low pressure column of the first unit.

means for removing the oxygen enriched stream from the low pressure column of the first unit in liquid form and vaporizing the stream so to form the gaseous product stream.

means for sending the stream containing more than 20 mol. % oxygen to the high and/or intermediate and/or or low pressure column of the first unit, said means being connected downstream of a heat exchanger of the first unit wherein air to be distilled in the high pressure column is cooled to a temperature suitable for distillation.

means for sending nitrogen enriched fluid from the first unit to the second unit and/or from the second unit to the first unit.

means for sending at least one fluid from the first unit to the second unit and means for expanding the fluid from the first unit within the second unit.

means for sending at least one liquid from the first unit to the second unit and means for vaporizing the fluid from the first unit within the second unit, preferably in a heat exchange line of the second unit.

In particular the process may be an integrated gasification combined cycle process in which oxygen from the air separation unit is sent to gasify a carbon containing substance thereby producing fuel for the combustor.

The term "fluid mixture" covers gaseous or liquid streams containing at least two components which have a different chemical composition. The fluid may alternatively contain both gaseous and liquid phases.

The term "subambient temperature" means a temperature below 10° C.

The term "cryogenic temperature" means a temperature below −100° C.

The term "product" means a gas or liquid which is removed from one of the units, does not return to either of the units and is not sent directly to the atmosphere.

The term "Claude turbine" means an air turbine whose exit is connected to a distillation column of the system other than the column operating at the lowest or lower pressure.

The term "fluid" means a gas or a liquid, a gas and a liquid or a dual phase gaseous-liquid mixture.

BRIEF DESCRIPTION OF THE DRAWINGS

The invention will now be described in further detail with reference to FIGS. 1 to 16 which are schematic flow sheets of variable capacity air separation units according to the invention in which.

DETAILED DESCRIPTION OF THE INVENTION

Figure 1:
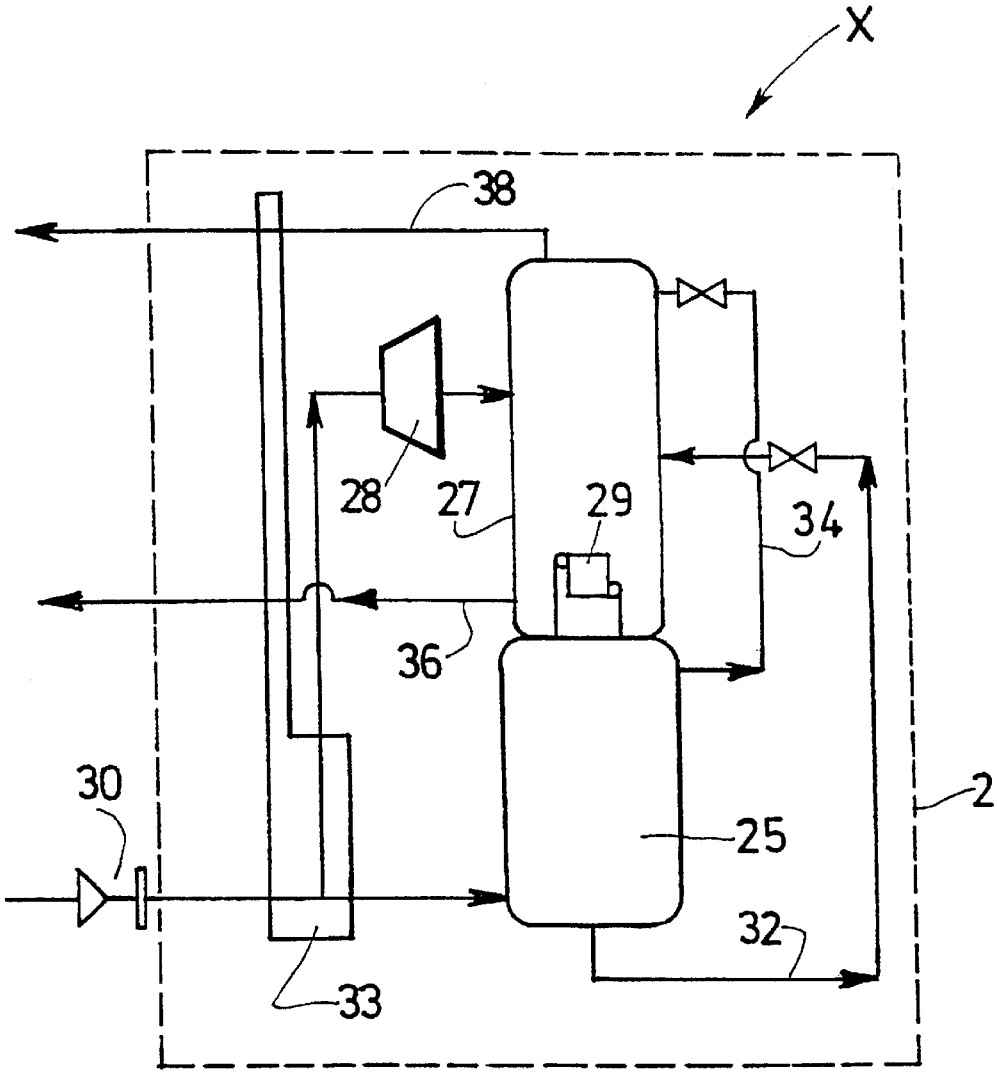
FIG. 1 shows a first unit before integration with a second unit.

In the process of FIG. 1, a first air separation unit X comprising a double distillation column with a high pressure column 25 and a low pressure column 27 thermally linked via a reboiler condenser 29 as in standard plants. The system may additionally include an argon separation column fed by the low pressure column. The operating pressures preferably vary between 4 and 25 bar for the high pressure column.

The air for the double column comes from a compressor 30 and is sent partly to the high pressure column 25 and partly to the low pressure column 27 following expansion in turbine 28, after purification and cooling in exchanger 33. Oxygen enriched liquid 32 is sent from the bottom of the high pressure column to the low pressure column following expansion and nitrogen enriched liquid 34 is sent from the high pressure column to the low pressure column as reflux. The system may additionally or alternatively use a Claude turbine feeding air to the high pressure column 25 or a nitrogen turbine expanding nitrogen from the high pressure column and/or low pressure column to produce refrigeration.

The heat exchanger 33, turbine 28 and columns 25, 27 are contained within cold box 2.

Gaseous oxygen 36 is produced from the low pressure column either directly by withdrawing a gas stream from the column or by vaporizing liquid oxygen in the main vaporizer-condenser or a separate vaporizer-condenser against a single gas stream. Waste or product nitrogen 38 is withdrawn from the top of the low pressure column 27.

In the version of FIG. 1, to give a numerical example of typical flows, 1000 Nm3/h of air for the double column come from a compressor 30 and are sent partly to the high pressure column 25 operating at 6 bars after cooling in exchanger 33 and partly (100 Nm3/h) to the turbine which feeds the low pressure column 27. Oxygen enriched and nitrogen enriched liquids 32, 34 are sent from the high pressure column to the low pressure column as reflux.

210 Nm3/h of gaseous impure oxygen 36 is produced from the low pressure column either directly or by vaporizing liquid oxygen. 790 Nm3/h of waste nitrogen 38 is withdrawn from the low pressure column.

Figure 2:
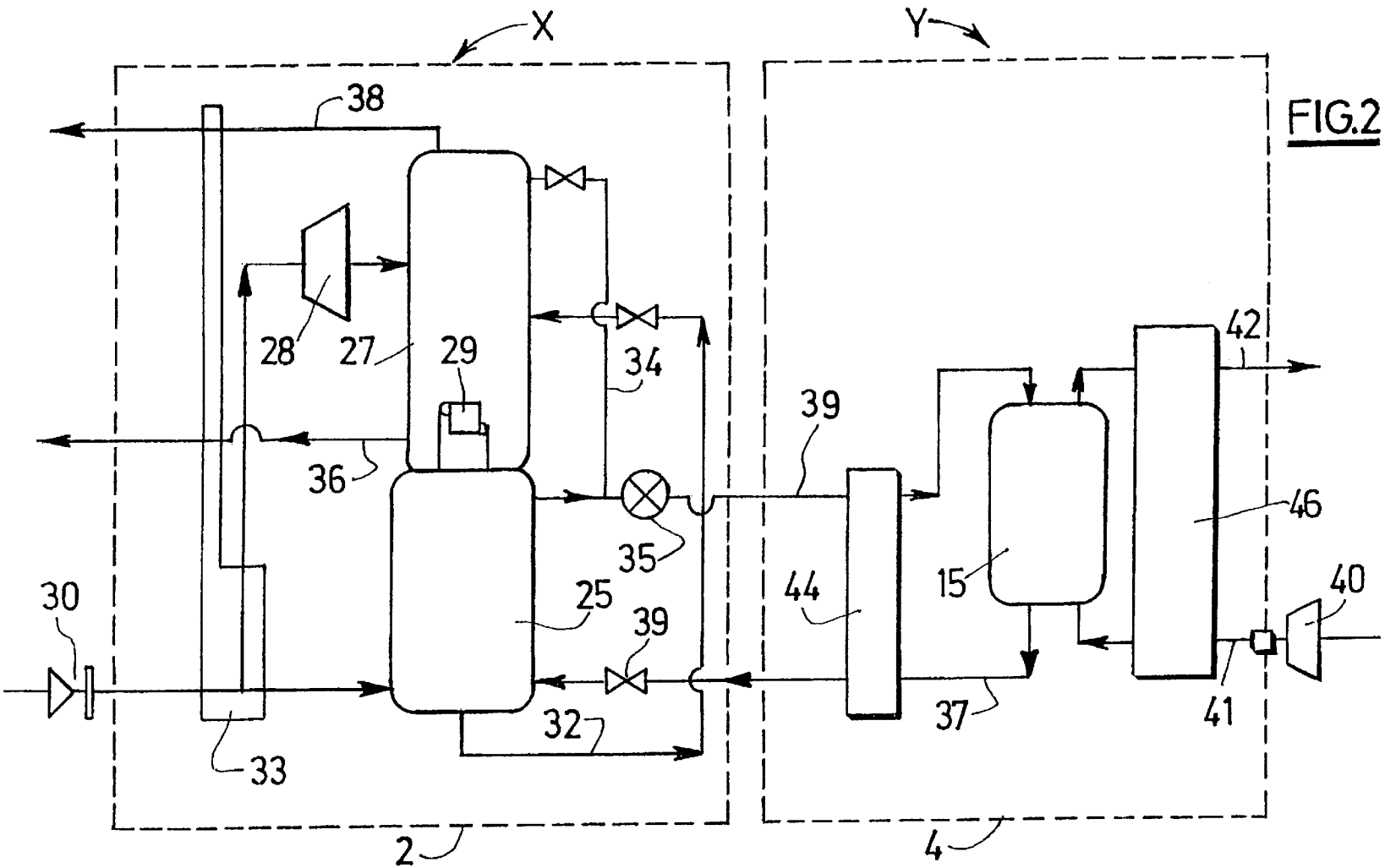
FIG. 2 shows the first unit of FIG. 1 following before integration with a second unit.

In order to increase production of the gaseous oxygen withdrawn from the low pressure column of the first unit X, a second air separation unit Y is added to the first unit as shown in FIG. 2. This second unit does not itself produce the extra product required but enables the production by the first unit to increase.

Part of the liquid nitrogen 34 from the top of the high pressure column 25 is sent to the top of the wash column 15 constituting second air separation unit following pumping in pump 35 to a pressure P, higher than the pressure of the high pressure column 25, for example 12 bars. The rest of the liquid nitrogen is sent to the top of the low pressure column of unit X as reflux as in FIG. 1.

The feed stream 39 to the top of the wash column may be pure liquid nitrogen or contain up to 5 mol. % oxygen.

The feed stream 41 to the bottom of the wash column at a pressure substantially equal to P comes from a compressor 40, which may be the compressor of a gas turbine and is preferably air or another gas containing oxygen and nitrogen less volatile than the liquid stream fed to the top of the wash column. The pressure P is preferably between 7 and 35 bar.

The wash column 15 is a column containing trays or structured packing and has no top vaporizer-condenser or bottom reboiler.

Liquid 37 containing between 27 to 40 mol. % oxygen from the bottom of column 15 is expanded in a valve 39 following cooling in exchanger 44 by heat exchange with the nitrogen feed stream 39 and sent to the bottom of the high pressure column or to the low pressure column, preferably after being mixed with oxygen rich liquid from the high pressure column.

It will be appreciated that the exchanger 44 is not an essential part of the apparatus and becomes necessary only when subcooling of one of the fluids is necessary. In certain cases the nitrogen rich liquid 39 will be warmed therein, there by cooling the liquid 37 and in others the nitrogen rich liquid 39 will be cooled therein, there by warming the liquid 37, depending on the pressure of column 15.

Gaseous nitrogen 42 is removed from the wash column 15 at a pressure between 7 and 25 bar, warmed in exchangers 46, reactivates air purification of the second unit Y and/or serves as a product and/or is sent to a gas turbine.

The second unit Y produces only the nitrogen rich product 42 and does not produce an oxygen rich product per se as the oxygen enriched liquid is sent to the first unit.

Due to the addition of unit Y, an additional amount of oxygen 36 can be removed from the low pressure column 27.

With the arrangement of FIG. 2, some liquid nitrogen or poor liquid 34 can be withdrawn from the existing medium pressure column of the first unit or any other point of the process such as the low pressure column. It can be pumped to the relevant pressure in order to feed the second unit which is a nitrogen wash column. The corresponding rich liquid 37 from the second unit will be returned to the low pressure column of the first unit with the normal rich liquid fed from the bottom of the medium pressure column to the low pressure column. Thus, some extra oxygen molecules will be fed to the column, allowing increased oxygen production (at the same or reduced purity, depending on the boosting ratio).

In certain cases, a nitrogen (or air) recycle compressor may be necessary to adjust the power requirements of the oxygen enriched product separation and compression cycle. To maintain the advantages of the global pressurized cycle, this compressor will preferably receive either air or nitrogen at medium pressure (above 3 bar).

Generally, the nitrogen wash column 15 is fed by liquid nitrogen containing at most 0.1 mol. % oxygen, preferably less than 10 ppm oxygen, and very impure oxygen containing at most 50 mol. % oxygen is removed in liquid rich phase at the bottom of the column. These liquids easily can be pumped and expanded, thus rendering this wash totally independent of the rest of the oxygen process.

It will be appreciated that the liquid nitrogen could be derived in part from an external source such as a remote storage tank periodically replenished by tanker trucks or a liquefier in which gaseous nitrogen, e.g. from a pipeline, is condensed rather than an air separation unit. Part of the oxygen enriched liquid from the first air separation unit may then be sent to another column or another user, or to liquefy after expansion the gaseous nitrogen from the pipe-line.

The first air separation unit may alternatively be a single column air separator generating liquid nitrogen, a standard double column with or without minaret, an air separation column having an external condenser, a double column in which oxygen enriched liquid from the bottom of the low pressure column is fed to a top condenser of the low pressure column or a triple column in which rich liquid from a high pressure column feeds a medium pressure column and liquid from the medium pressure column feeds the low pressure column for example of the type shown in FR1061414 or EP538118.

The first air separation unit may produce other liquids in addition to the nitrogen and other gaseous products. Gases may be produced at high pressure by pumping and vaporizing liquids withdrawn from columns of the first air separation unit.

One advantage of the present system is that the first air separation unit and the second air separation unit can operate independently by providing storage tanks for the liquid nitrogen from the first air separation unit and the oxygen enriched liquid from the second air separation unit to provide a type of bascule system.

Thus when the second air separation unit is not operational, for example when there is a reduced demand for gaseous oxygen from the first unit, the second air separation unit draws liquid nitrogen from the storage. Similarly when the second air separation unit is not operational the oxygen enriched liquid is removed from the storage and sent to the first air separation unit.

In the version of FIG. 2, to give a numerical example of typical flows, 1000Nm3/h of air for the double column come from a compressor 30 and are sent partly to the high pressure column 25 after cooling in exchanger 33 and partly (100Nm3/h) to the turbine which feeds the low pressure column 27. Oxygen enriched and nitrogen enriched liquids 32, 34 are sent from the high pressure column to the low pressure column as reflux.

265Nm3/h of gaseous impure oxygen 36 is produced from the low pressure column either directly or by vaporizing liquid oxygen. 735Nm3/h of waste nitrogen 38 is withdrawn from the low pressure column. Thus the oxygen producing capacity of the FIG. 2 system is 126% of that of the FIG. 1 system.

180Nm3/h of liquid nitrogen 39 from the top of the high pressure column 25 is sent to the top of wash column 15 following pumping in pump 35. 180Nm3/h of liquid 37 containing 55Nm3/h oxygen from the bottom of column 15 is expanded in a valve 39 and sent to the bottom of the high pressure column or to the low pressure column 0.300Nm3/h of air 41 is sent to the bottom of the further column 15 and 300Nm3/h of gaseous nitrogen 42 is removed from the top.

These calculations are slightly simplified to the extent that the latent heat of vaporization of oxygen and nitrogen are assumed identical. The slight adjustments necessary to account for the actual difference in latent heat fall under the domain of routine calculation.

The further column 15 of the second unit may be contained in a second cold box 4 together with the exchanger 44 in which the feed liquid nitrogen is heated following pressurization against the bottom liquid of the further column and the exchanger 46 in which the feed air 41 for the further column 15 is cooled against the product gaseous nitrogen 42 from the further column. Attentively the second unit may be contained within the cold box 2.

It will be appreciated that the air for the further column need not come from the compressor of a gas turbine. It may come from a dedicated compressor or any other source of compressed air.

In particular the existing air separation unit X may include an argon column or a mixing column and/or may comprise a triple column rather than a double column.

With an apparatus of this sort having an additional wash column, it becomes possible to increase the capacity of the existing air separation unit X (i.e. the double or triple column) by 25% for impure oxygen by adding a further air separation column Y.

The combined air separation unit X and further column Y will produce a greater proportion of oxygen 36 and consequently a lesser proportion of waste nitrogen 38 than the air separation unit X alone. For this reason, more oxygen can be produced with less waste nitrogen. In general, the waste nitrogen circuits are the bottleneck for increased oxygen production by simple feed air flow boosting.

It may be necessary to change the allocation of passages in the heat exchanger 33 to allow for the fact that more oxygen and less nitrogen are produced in the case of FIG. 2 than in the case of FIG. 1.

It will be appreciated that the wash column 15 need not operate at a pressure higher than the pressure of the high pressure column. It may for example operate at a pressure between 1.2 and 5 bars or a pressure approximately equal to the high pressure (e.g. between 5 and 7 bars).

Where the pressure of the wash column 15 is lower than the high pressure, the nitrogen rich liquid 39 will be expanded, possibly in a valve before being sent to the wash column and the oxygen enriched fluid 37 will be pumped to the high pressure.

There are new separation power requirements for purifying the additional oxygen introduced in the air separation unit. This extra power can be obtained, either by decreasing the purity of part or all oxygen 36 produced; or by reducing the total amount of gas expanded in one or more turbines 28 to produce refrigeration (thus possibly reducing liquid production), taking into account that the further column will require additional cooling or by reducing the high pressure gaseous nitrogen production.

To improve the capacity of an existing double column air separation plant producing oxygen, it is possible to revamp the column by adding a mixing column. The mixing column is fed at the top with liquid oxygen from the low pressure column and at the bottom of the column with air or another gas more volatile than the oxygen and which contains oxygen. Impure oxygen is produced at the top of the mixing column and bottom and intermediate liquids from the mixing column are sent to the low pressure column and/or the medium pressure column. The functioning of a column of this type is described in U.S. Pat. No. 4,022,030. The mixing column may be fed with air from a different compressor to that used to feed the existing double column.

In the next case an existing air separation unit comprising a medium pressure column and a thermally linked low pressure column produces insufficient oxygen for the requirements of a customer.

In order to boost the production of the first air separation unit, a second unit constituted by further column is installed which treats feed air and sends a treated gas to feed the air separation unit.

Figure 3:
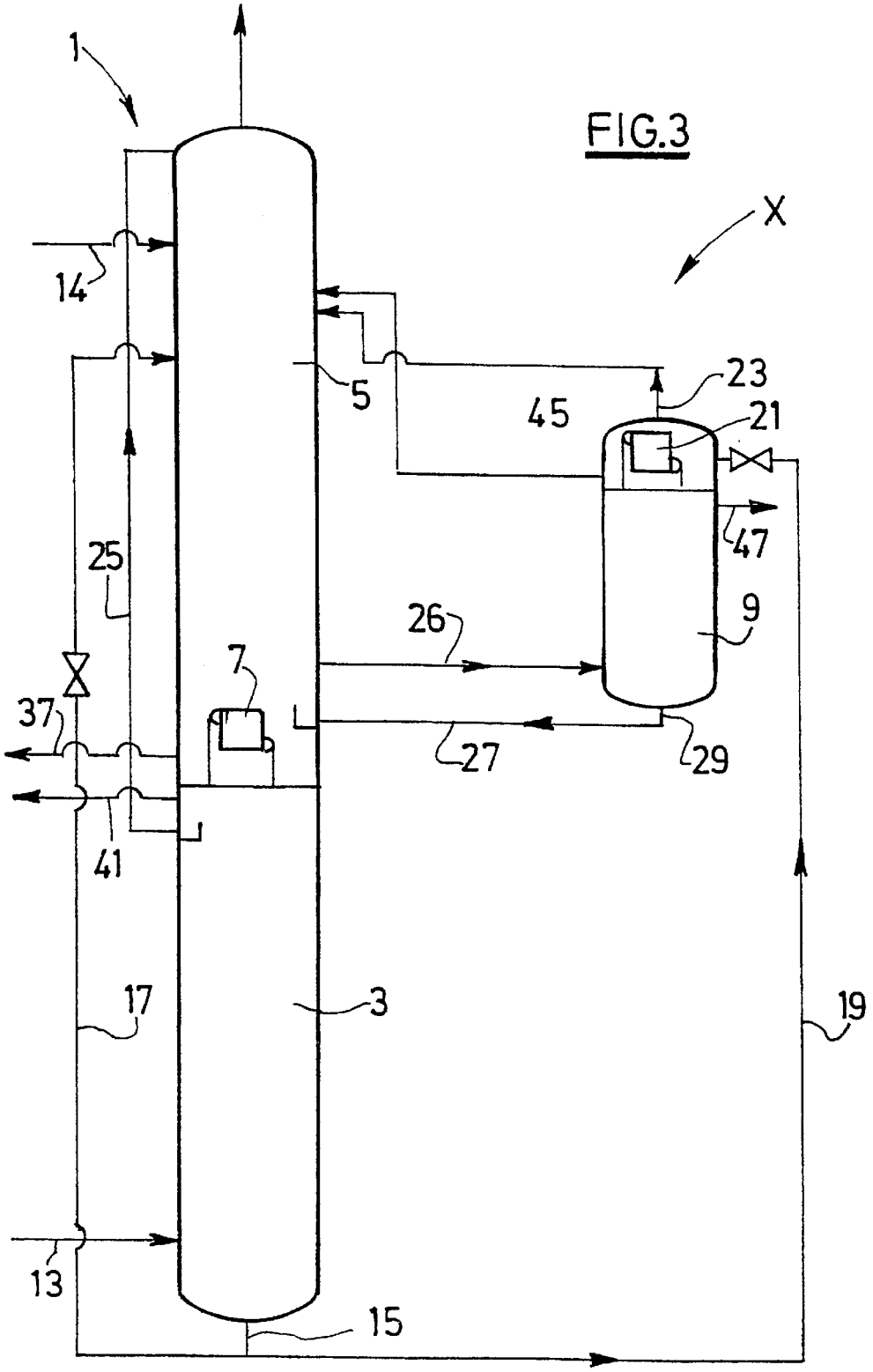
FIG. 3 shows another first unit before integration with a second unit.

In the apparatus of FIG. 3, an existing plant comprises a double column 1 from which an oxygen enriched fluid is withdrawn from the low pressure column 5 to form a product. Air 13 is sent to the high pressure column 3 and part 17 of the oxygen enriched liquid 15 is sent directly from the high pressure column to the low pressure column, and part 19 of the oxygen enriched liquid undergoes a vaporization step in the case where there is an argon column 9. Where there is an argon column at least part of the oxygen enriched liquid is sent to the top condenser 21 of the argon column 9, partially vaporized and sent to the low pressure column as liquid stream 45 and gaseous stream 23. Where there is no argon production the oxygen enriched liquid is simply expanded in a valve and sent to the low pressure column 5 via conduit 17.

In the existing column, the bottom of the low pressure column is heated by a heating gas sent to reboiler 7. In the example the only heating gas is nitrogen from the high pressure column 3 but the heating gas may alternatively be air.

Figure 4:
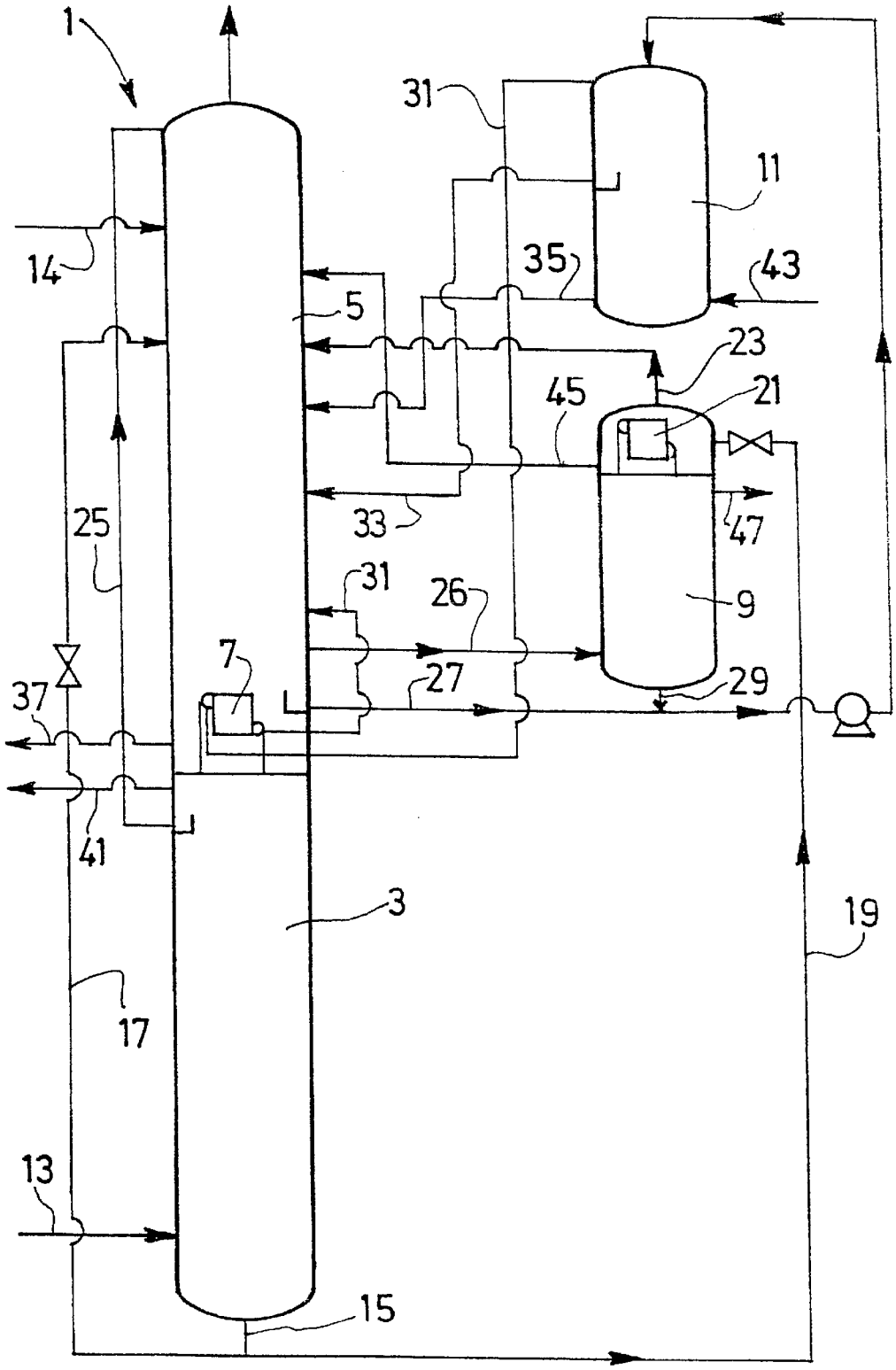
FIGS. 4 and 5 show the first unit of FIG. 3 following before integration with two different second units.
Figure 5:
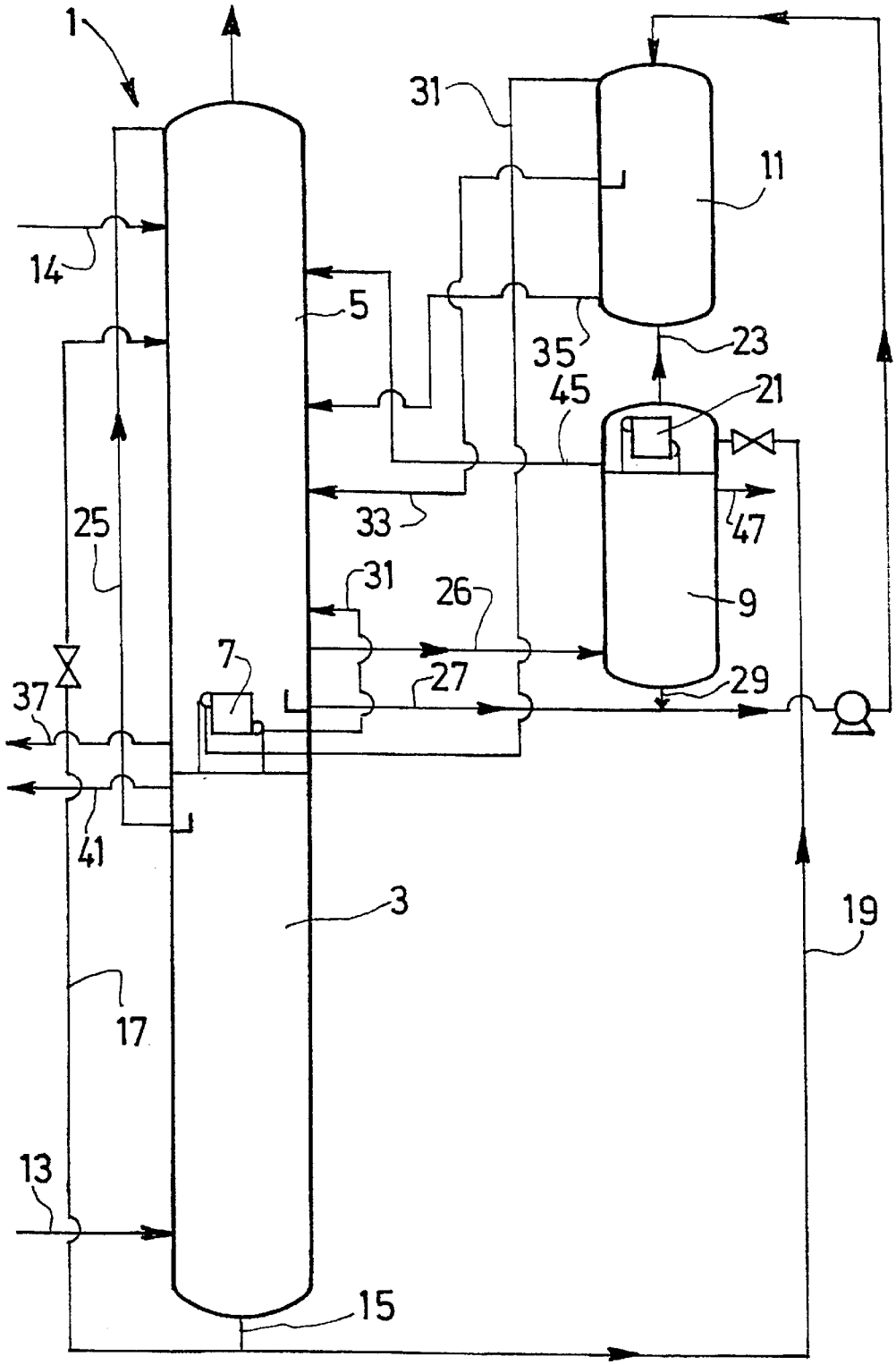

In order to boost the oxygen and/or nitrogen and/or argon production of the unit X of FIG. 3, two alternative means are proposed as shown in FIGS. 4 and 5.

In the system of FIG. 4, the system may or may not include an argon column.

A second unit Y consisting of a mixing column 11, connected to send liquid to the low pressure column 5, is added to the first unit X. The mixing column is fed at the top by a liquid stream 27 from the lower part of the low pressure column 5. The stream is rich in oxygen and preferably contains at least 80 mol. % oxygen. The liquid is pumped to a suitable pressure which is higher than the pressure of the low pressure column an preferably higher than the pressure of the high pressure column 3.

The mixing column 11 is fed at the bottom by an air stream 43 or another stream less volatile than the liquid stream fed to the top of the column.

The gaseous stream removed from the top of the mixing column 11 may either be sent directly to the low pressure column or preferably is sent to the reboiler 7 where it serves as an additional heating gas, is thereby condensed and sent to the low pressure column in at least partially liquid form 31. The bottom and intermediate liquid streams 33, 35 from the mixing column 11 are sent to the low pressure column 5, stream 33 being sent to a point below stream 35.

Alternatively as shown in FIG. 5, the mixing column bottom feed may be part or all of the vaporized rich liquid from the top condenser 21 of the argon column 9. The vaporized rich liquid typically contains between 25 and 40 mol. % oxygen.

In the cases of FIGS. 4 and 5, the amount of oxygen 37 which may be withdrawn increases. In the case of FIG. 4 the amount of air sent to the double column does not necessarily increase since there is a separate air feed to the mixing column. However in the case of FIG. 4 where the air for the mixing column is in fact derived from the same compressor as streams 13 and 14, the air flow to that compressor will increase. In the case of FIG. 5, the air flow to the double columns via streams 13, 14 must increase to provide the additional oxygen.

Figure 6:
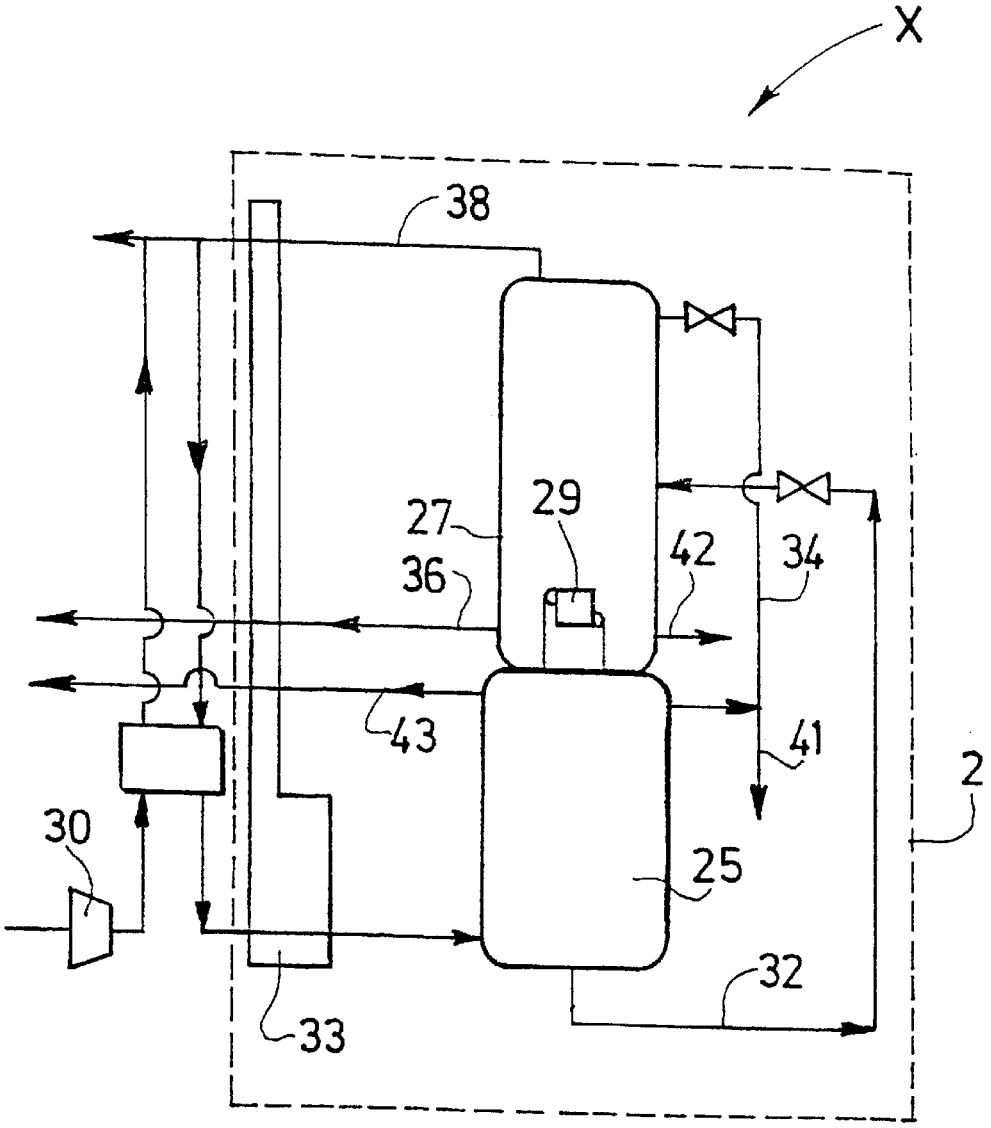
FIG. 6 shows another first unit before integration with a second unit.

In the apparatus of FIG. 6, a first air separation unit X comprises a double distillation column with a high pressure column 25 and a low pressure column 27 thermally linked via a reboiler condenser 29 as in standard plants. The system may additionally include an argon separation column fed by the low pressure column. The operating pressures preferably vary between 4 and 25 bar for the high pressure column.

The air for the double column comes from a compressor 30 and is sent to the high pressure column 25, after purification and cooling in exchanger 33. Oxygen enriched liquid 32 is sent from the bottom of the high pressure column to the low pressure column following expansion and nitrogen enriched liquid 34 is sent from the high pressure column to the low pressure column as reflux. The system may use a Claude turbine, or a nitrogen turbine (not illustrated) or other known means to produce refrigeration.

The heat exchanger 33 and columns 25, 27 are contained within the cold box.

Gaseous oxygen 36 is produced from the low pressure column either directly by withdrawing a gas stream from the column or by vaporizing liquid oxygen in the main vaporizer-condenser or a separate vaporizer-condenser against a single gas stream. Waste or product nitrogen 38 is withdrawn from the top of the low pressure column 27. Gaseous nitrogen 43 is removed from the top of the high pressure column 25.

Figure 7:
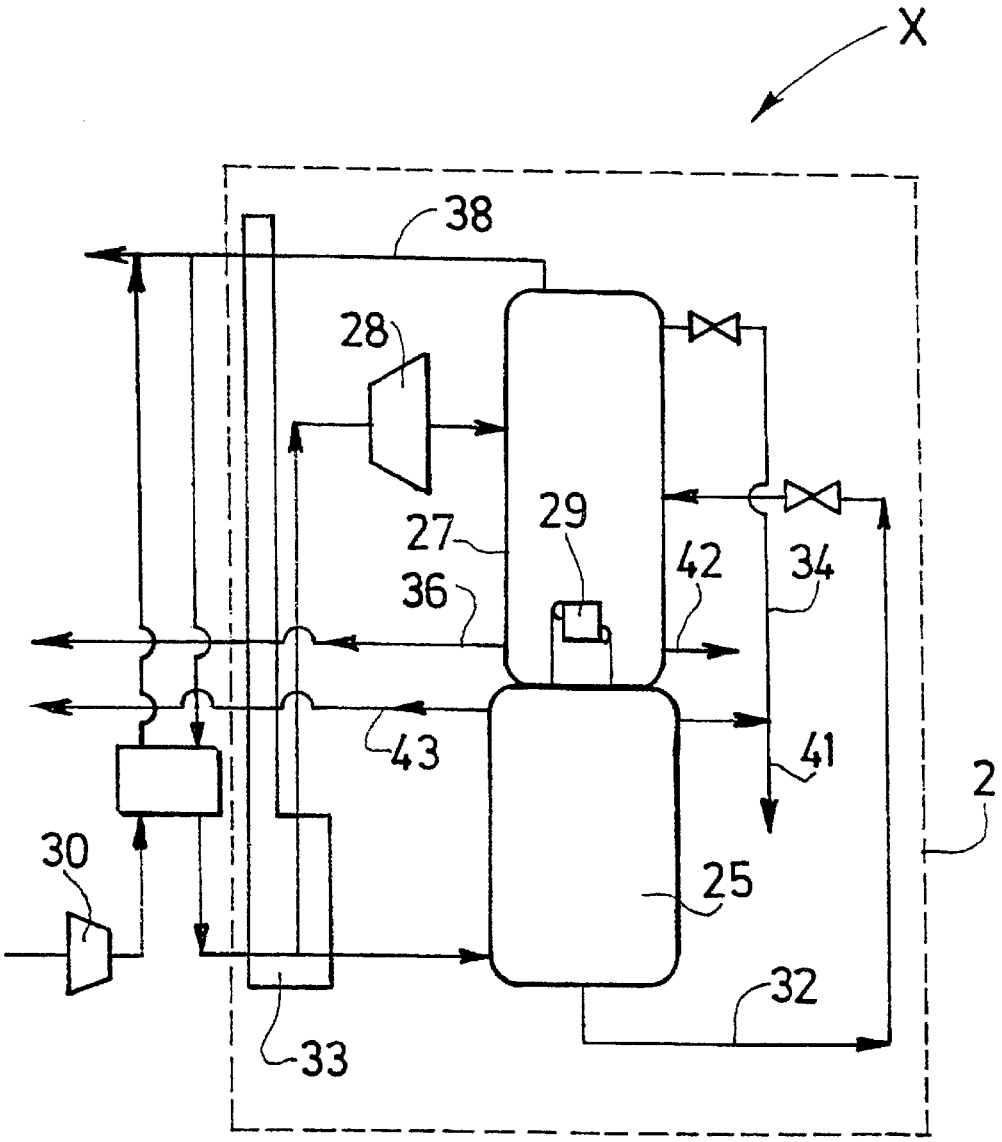
FIGS. 7 to 12 show the first unit of FIG. 6 following before integration with five different second units.

In order to boost the amount of liquid product, as shown in FIG. 7 a second unit consisting of an air turbine may be integrated with the first unit. In this case with or without increasing the amount of air sent to the compressor 30, part of the cooled air is sent to turbine 28 and thence to the low pressure column 27. In this case, the amount of gaseous oxygen 36 is reduced but the amount of liquid nitrogen 41 and/or liquid oxygen 42 is increased.

Figure 8:
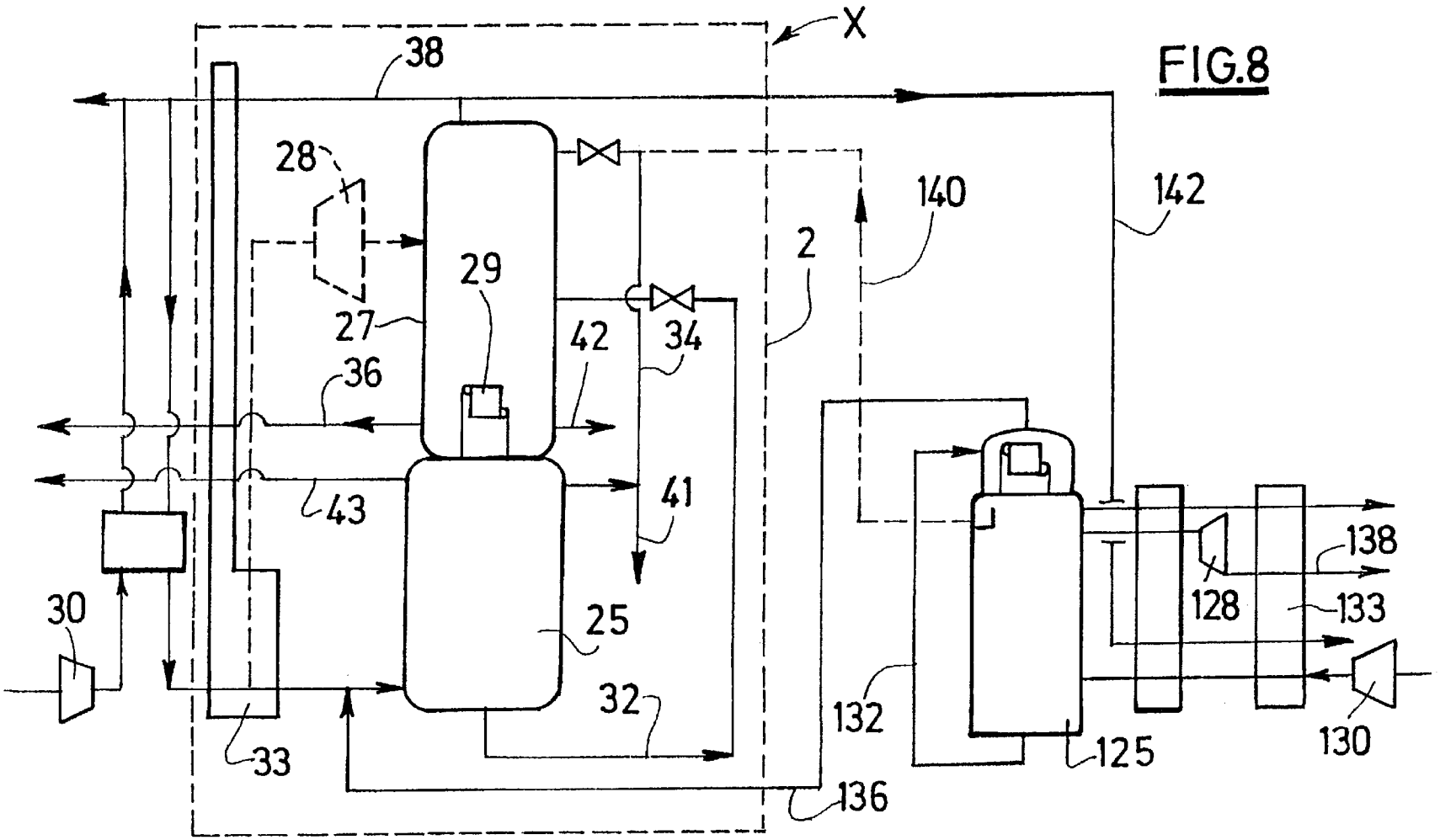

In the apparatus of FIG. 8, in order to increase the amount of gaseous oxygen which may be produced; a second unit is added to the first unit forming the existing plant shown in FIG. 6.

This second unit is a single column nitrogen generator.

A further stream of air is compressed to 9 bars in compressor 130, separately purified and cooled in exchanger 133 and then sent to the second unit within the same cold box as the.double column 25, 27 The heat exchangers 33, 133 are also preferably within the same cold box. This second unit is a single distillation column 125 having a top condenser 129. Oxygen enriched liquid 132 containing between 25 and 45 mol. % oxygen from the bottom of the column 125 is vaporized in the top condenser and sent to the first column 25 after being mixed with the air stream to that column. The vaporized oxygen enriched liquid 136 leaves the condenser 129 and enters the first column 25 at cryogenic temperatures down stream of exchanger 33 and is preferably not subjected to any warming or cooling steps between the top condenser and the first column.

At least part of the nitrogen enriched gas 138 from the top of the column is warmed in an exchanger, expanded in a turbine 128 and then warmed to ambient temperature in further exchanger 133.

The turbine 128 may optionally provide all the refrigeration for the air separation unit and the second column and therefore the turbine used for the existing plant is no longer required. Alternatively turbines 28 and 128 are both used and the liquid production of the plant may be increased.

Other optional features include:

- the sending of a nitrogen enriched stream 142 from the top of the low pressure column 27 to the heat exchanger 133 in which it is warmed to ambient temperature
- the sending of liquid rich in nitrogen 140 from the top of single column 125 to the top of column 27 to serve as additional reflux
- the removal of a product nitrogen stream from the top of the column 25 which is not expanded in a turbine.
- at least part of the liquid 132 from the base of column 125 can be sent directly to the column 25 or 27 without undergoing a vaporizing step.

Figure 9:
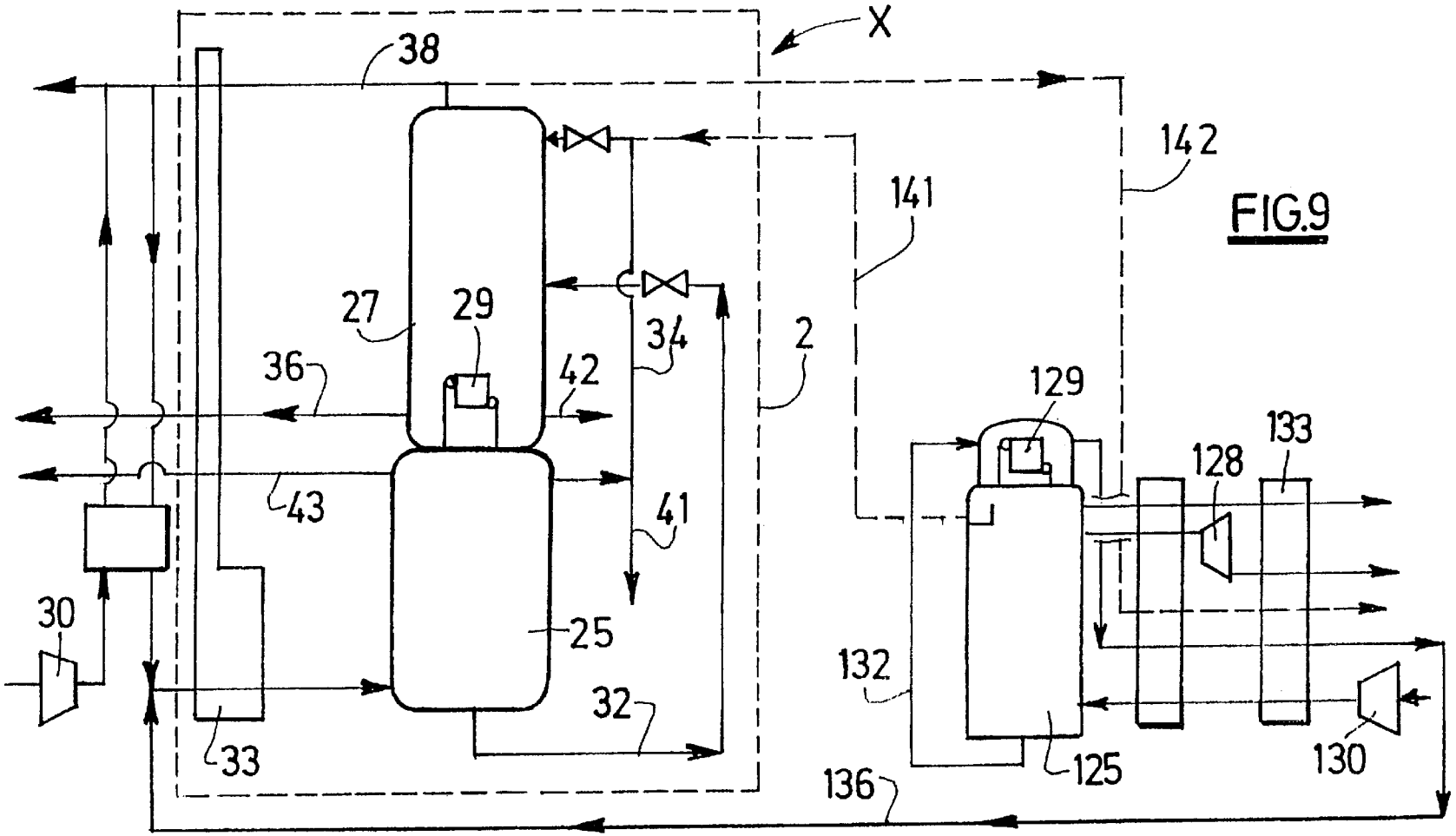

FIG. 9 differs from FIG. 8 in that the vaporized rich liquid 136 is sent from the condenser 129 of the column 125 to a first exchanger and then to exchanger 133 where it is warmed to ambient temperature and is then sent to unit X downstream of the purifying unit and is sent with the purified air to the column 25.

Optional features of this FIG. 9 include:

- the sending of a nitrogen enriched stream 142 from the top of the low pressure column 27 to the heat exchanger 133 in which it is warmed to ambient temperature
- the sending of liquid rich in nitrogen 141 from the top of single column 125 to the top of column 27 to serve as additional reflux
- the removal of a product nitrogen stream from the top of the column 25 which is not expanded in a turbine
- at least part of the liquid 132 from the base of column 125 can be sent directly to the column 25 or 27 without undergoing a vaporizing step.

Figure 10:
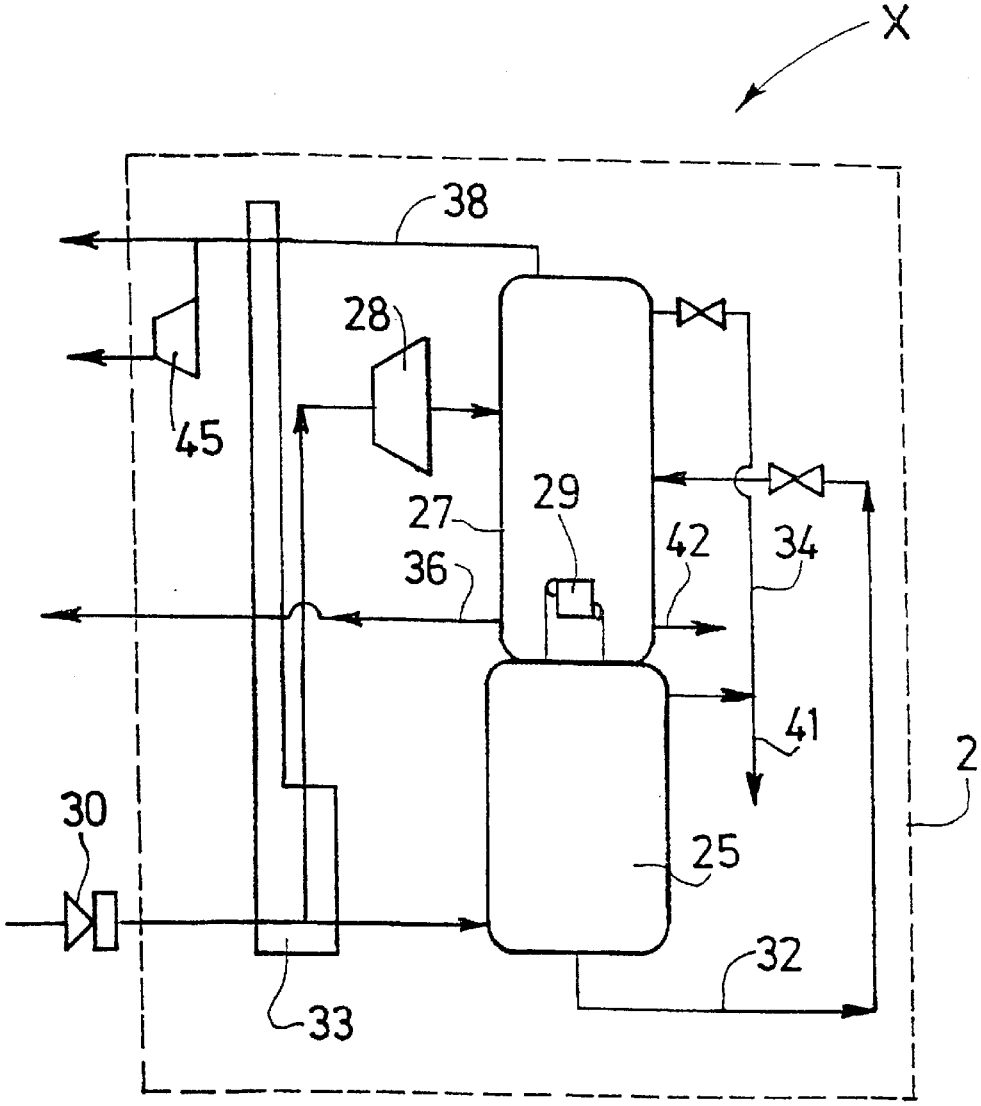

As shown in FIG. 10, in order to remove more high pressure nitrogen from the system of FIG. 6, a second unit 45 which is a nitrogen compressor may be added. High pressure nitrogen is no longer removed from the top of the high pressure column and thus more reboil is available for condenser 29 and more gaseous oxygen 36 can be removed from the column 27. The nitrogen required is produced by compressing part of the low pressure nitrogen 38 in compressor 45.

Figure 11:
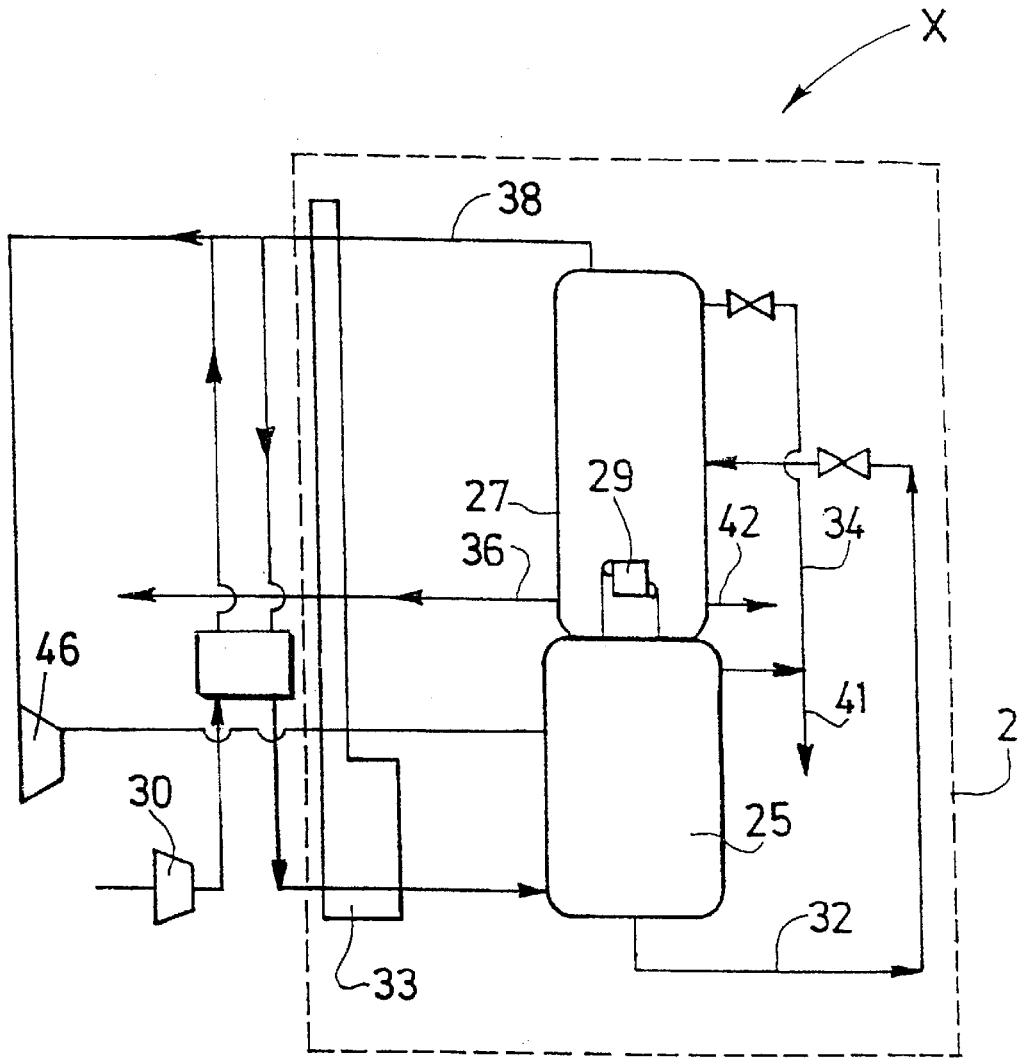

In the system of FIG. 11, the amount of liquid nitrogen and liquid oxygen which can be produced is increased by recycling part or all of the low pressure nitrogen to a compressor 46, liquefying it in heat exchanger 33 and sending the liquid to the top of the high pressure column 25.

Figure 12:
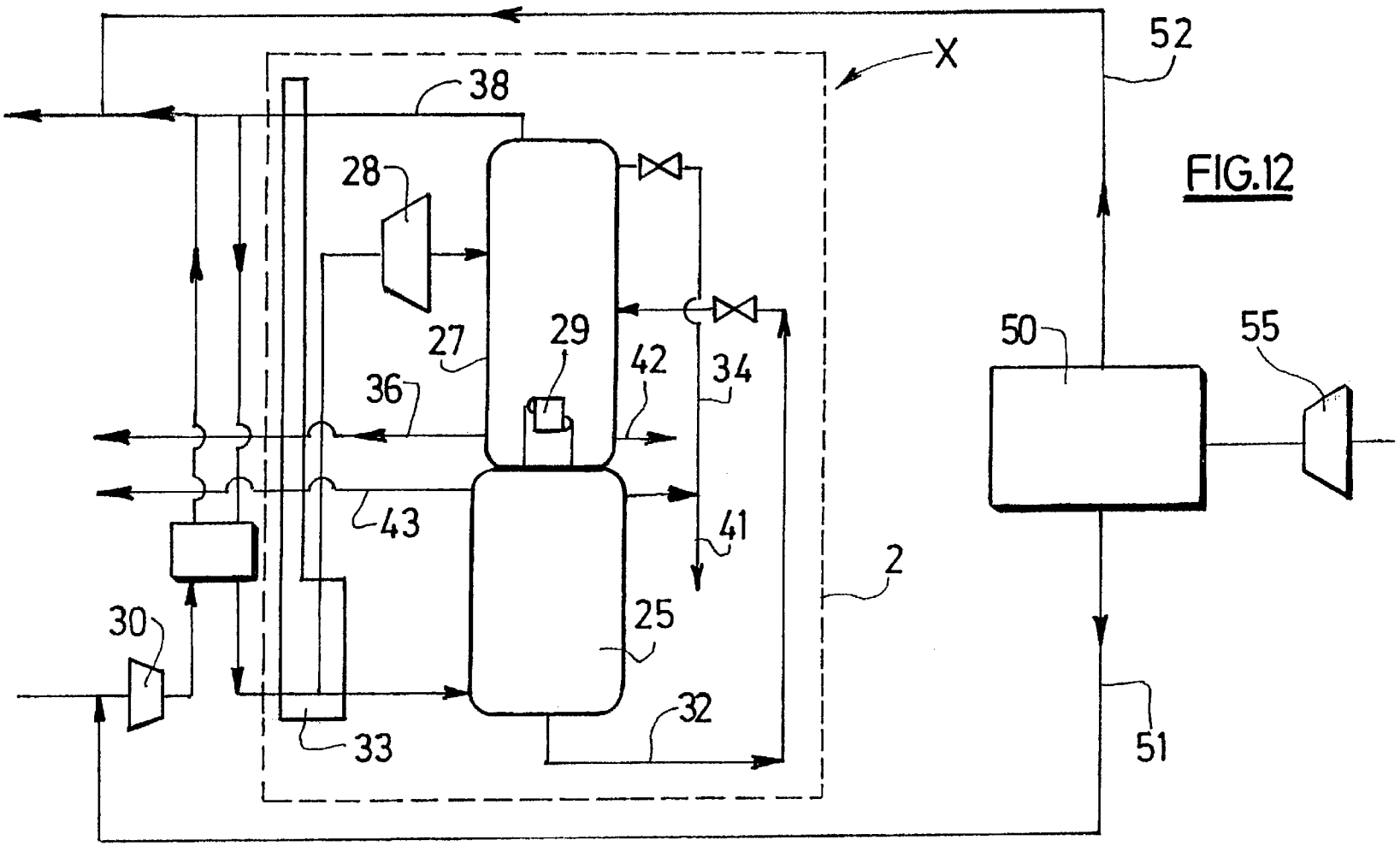

In the system of FIG. 12, an additional air stream is sent to a VSA unit 50 (or alternatively a permeation unit) from a compressor 55. Oxygen enriched air 51 is sent from the VSA to the high pressure column 25 in order to boost production of oxygen 36. At the same time nitrogen enriched air 52 is mixed with product stream 38 withdrawn from the low pressure column.

It will of course be understood that the integration of the second unit may involve either bringing a second unit onto the site of the first unit or else merely operably connecting a second unit already present on the site of the first unit which did not operate in an integrated manner with the first unit prior to integration.

In cases where the total amount of fluids sent to the distillation column producing the increased amount of product increases, the distillation column must of course be dimensioned to allow for this increase.

Similarly, depending on the size of the increase in product, it may be necessary to use additional product compressors or pumps to cope with the increase in flow.

Figure 13:
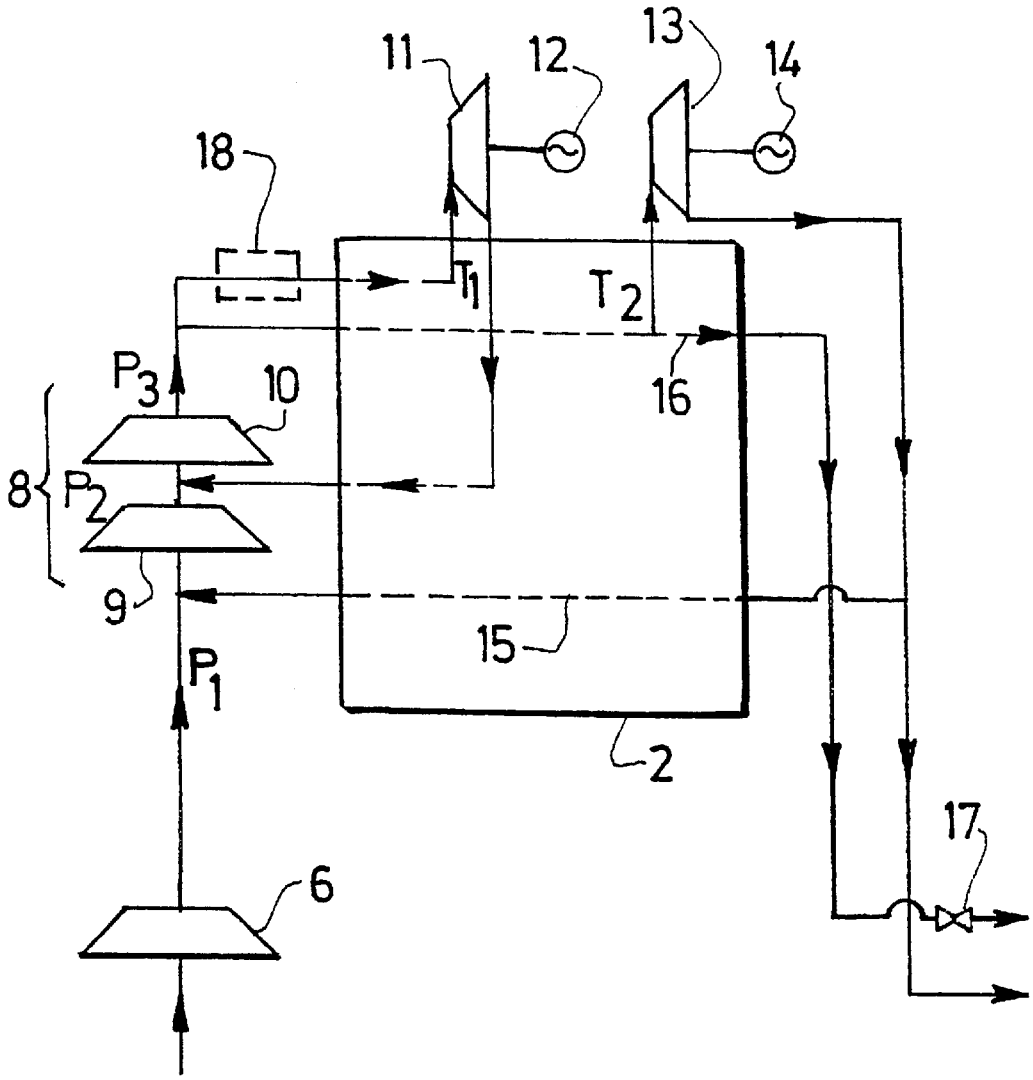
FIG. 13 shows another first unit before integration with a second unit.

FIG.13 shows a first unit which is a liquefier X which may for example be used for liquefying nitrogen or air. The unit X comprises a first compressor 6 to which all the fluid to be liquefied is fed and which compresses the fluid to P1 bar. The second compressor 9 compresses the fluid at P1 bar to P2 bar and the third compressor 10 compresses the fluid at P2 bar to P3 bar. The compressed fluid is then divided in two and cooled in a heat exchanger 2. Part of the compressed fluid is liquefied in the exchanger 2 and emerges therefrom as the product liquid via valve 17. Part 16 of the compressed fluid is expanded in a turbine 11 having an inlet temperature T1 and outlet pressure P2 and the rest of the fluid is expanded in turbine 13 having inlet temperature T2 and outlet pressure P1. The stream from the turbine 11 and the stream 15 from the turbine 13 are recycled upstream of the third and second compressors respectively. Part of the expanded fluid from turbine 13 may be sent to a distillation column or used elsewhere.

Figure 14:
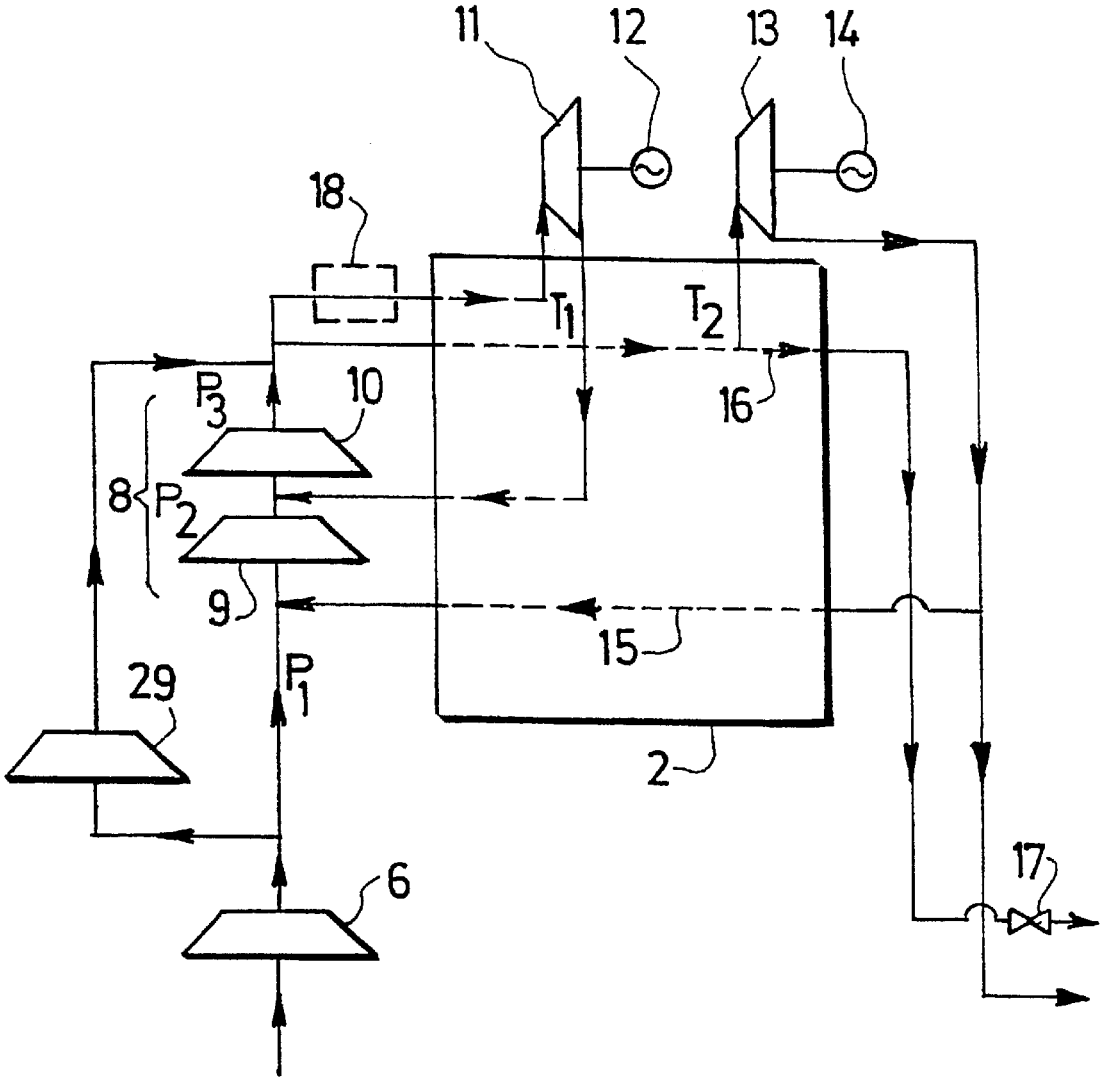
FIG. 14 shows the unit of FIG. 13 following integration with a second unit.

FIG.14 shows that the amount of fluid liquefied may be increased by up to 20% by sending an additional amount of fluid to a fourth compressor 29 which compresses the fluid from P1 bar to P3 bar before it is sent downstream of the third compressor 10 and upstream of the heat exchanger. The second unit is in this case the fourth compressor 29 with the conduits linking it to the first unit. Part of the fluid from the third compressor may be sent to the turbine 11 or 13. In this case it may be necessary to send all the fluid from turbine 13 to compressor 9.

It will be noted that the recycled fluid 15 from the turbine 13 is not sent to the fourth compressor 29 since the fluid is sent to the compressor upstream of the point at which the recycle stream 15 joins the fluid at pressure P1.

As obvious alternatives, the compressor 6 may be omitted and the compressor 9 and 29 may compress fluid at atmospheric pressure.

The fluid sent to compressors 9 and 29 need not be derived from a common source.

According to a further object of the invention there is provided a liquefier having first means for compressing a fluid from pressure P1 to pressure P3 and second means for compressing a fluid from pressure P1 to pressure P3, means for sending fluid from said first and second means to a heat exchanger, means for expanding at least part of the fluid and means for collecting at least part of the fluid in liquid form.

Preferably there are means for recycling at least part of the expanded fluid to the compression means and preferably to only one of the compression means.

The system can obviously be simplified by omitting the compressor 10 and/or turbine 11. In the case where compressor part of the air from compressor 9 is sent to turbine 13 and then either recycled upstream of compressor 9 or removed from the liquefier. In this case, the compressor 29 is connected in parallel with the compressor 9 only.

According to a further aspect of the invention, there is provided a process for liquefying a fluid whereby two streams are compressed by separate compression means to a same pressure and the two streams are sent to a heat exchanger, at least part of the fluid sent to the heat exchanger is liquefied and at least part of the fluid is expanded in at least one expander.

Preferably the amount of fluid sent to one of the compression means is less than that sent to the other compression means.

Figure 15:
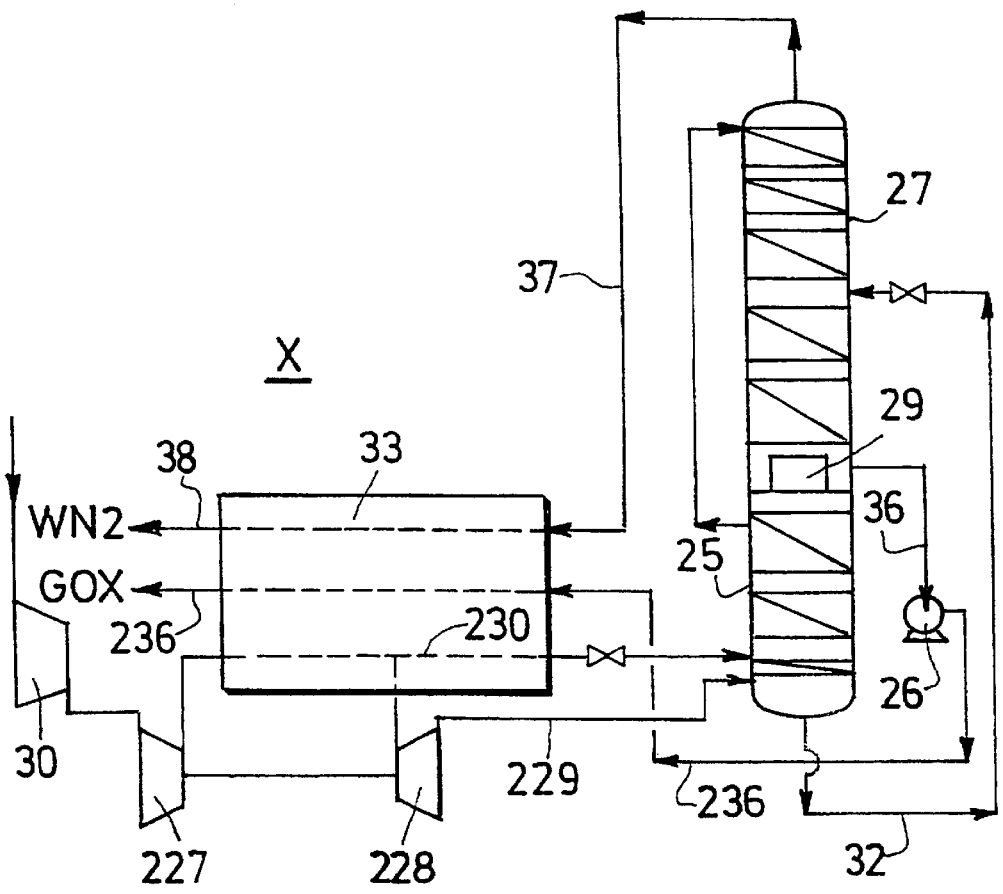
FIG. 15 shows another first unit before integration with a second unit.

FIG. 15 shows a first air separation unit comprising a double column with a high pressure column 25 and a low pressure column 27 thermally linked by a condenser 29 which condenses nitrogen enriched gas from the top of the high pressure column.

The high pressure column operates at around 6 bars and the low pressure column operates at around 1.3 bars.

Air is compressed in compressor to 35 bars, purified (not shown) and then sent to booster 227 where it is compressed to 40 bars. The compressed air is then cooled in exchanger 33 to an intermediate temperature at which it is divided in two fractions 229, 230. Fraction 230 is further cooled, liquefies, is expanded in a valve and sent to the high pressure column at least partially in liquid form. Fraction 229 is expanded to the pressure of the high pressure column in Claude turbine 228 and then sent to the high pressure column.

Oxygen enriched liquid 32 is removed from the bottom of the high pressure column 25 and sent to the low pressure column following expansion. Nitrogen enriched liquid is removed from the top of the high pressure column 25 and sent to the top of the low pressure column following expansion.

Nitrogen enriched waste gas 37 is removed from the top of the low pressure column 27 and sent to the exchanger where it is warmed to ambient temperature.

Oxygen rich liquid 36 is removed at the bottom of the low pressure column, pressurized by pump 26 to 40 bars and vaporized in exchanger 33 to form product gaseous oxygen 236.

If the oxygen produced must be pure or if argon is required, an argon column is used and is fed from the low pressure column in the standard manner. The first unit may optionally comprise a mixing column of the type described in FR-A-2169561 or EP-A-0531182 or other well-known types of mixing column.

Other obvious modifications such as different operating pressures, production of high pressure gaseous nitrogen from the high pressure column, nitrogen or argon internal vaporization may of course be envisaged.

Figure 16:
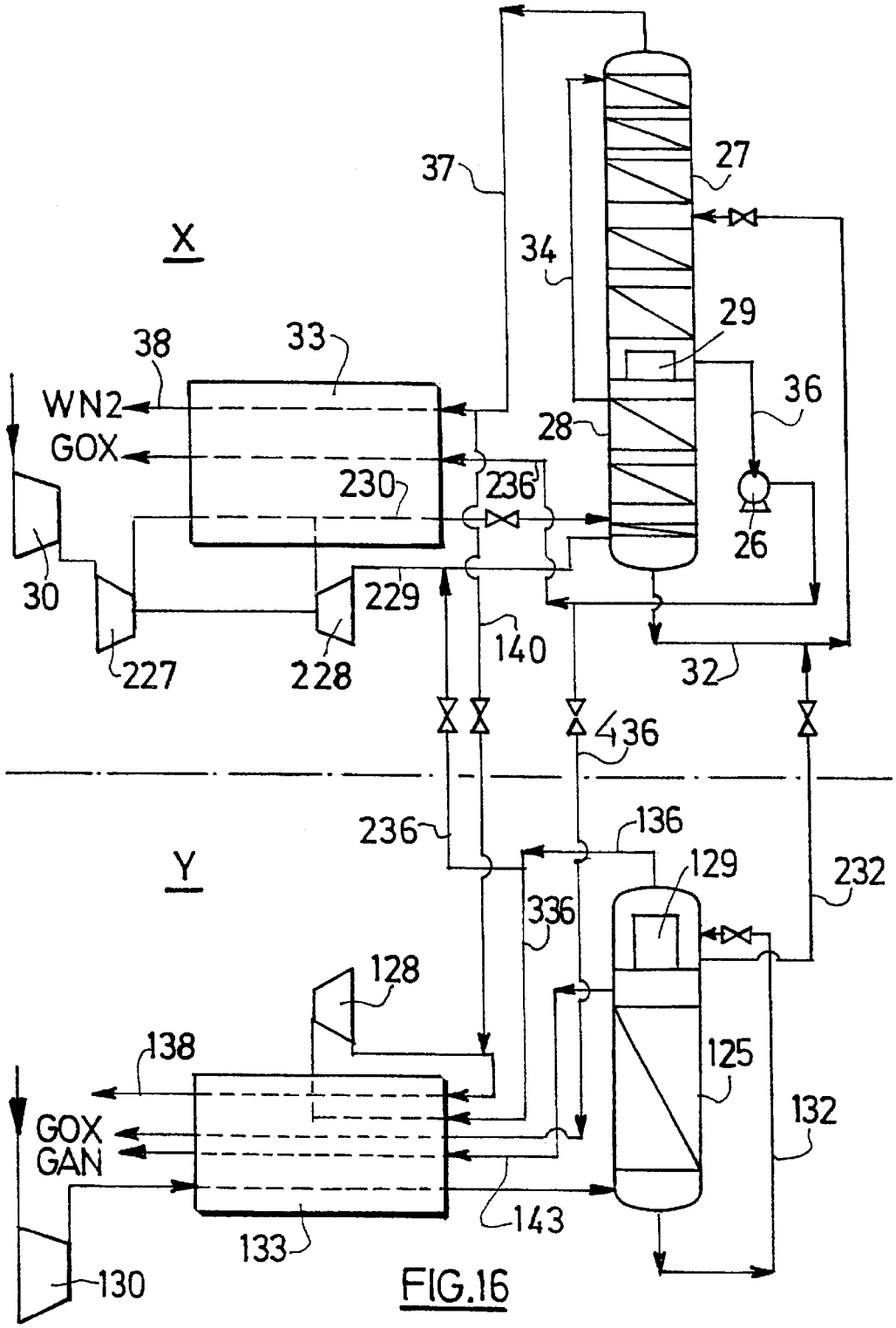
FIG. 16 shows the unit of FIG. 15 following integration with a second unit.

In the case where the amount of oxygen rich gas 236 is no longer sufficient for the customer's requirements, the apparatus is modified as shown in FIG. 16 by integrating apparatus Y.

Second apparatus Y comprises a single column air separation column 125 having a top condenser 129, a heat exchanger 133 and an air compressor 130.

It will readily be understood that the single column could alternatively be the high pressure column of a standard double column or could include a distillation section above the top condenser to enrich the bottom oxygen enriched liquid before it is sent to the top condenser.

The air is compressed to 9 bars by compressor 130, purified (not shown) and cooled in exchanger 133 to a cryogenic temperature before being sent to the bottom of single column 125. Oxygen enriched liquid 132 containing between 25 and 45 mol. % oxygen is sent from the bottom of the column 125 to condenser 129, following expansion, where it is partially vaporized to form a liquid stream 232 at 6 bars and a gas stream 136 at 6 bars.

Liquid stream 232 is incorporated into stream 32 of FIG. 15 and sent to the low pressure column 27. Gas stream 136 is divided into two fraction 236, 336. Fraction 236 is mixed with the air 229 from Claude turbine 228 and sent to the high pressure column 25.

Stream 336 is expanded in turbine 128 following a warming step in exchanger 133 and is then further warmed to ambient temperature following mixing with a stream 140 of waste nitrogen from the low pressure column 27.

Optionally a small part 436 of the liquid oxygen from the first unit is vaporized in the heat exchanger 133 of the second unit.

The net effect of sending the oxygen enriched streams 232, 236 from the second unit to the first unit is to enable an increased amount of oxygen 36 to be withdrawn from the low pressure column 27. This increased amount of oxygen may be vaporized in total in exchanger 33 of the first unit or in part in that exchanger 33 and in part elsewhere e.g. in exchanger 133. The increase in the amount of oxygen produced is in the region of 30% of the maximum production of the unit of FIG. 15.

The purity of the oxygen 36 is slightly reduced following integration of unit Y from 99.995 mol. % to 99.99 mol. % however in many cases this is acceptable.

The dashed line between the two units X and Y of FIG. 16 simply indicates the different units. Preferably the two units will be within the same cold box or failing this, the transfer of fluids 140, 232, 236, 336 will nevertheless take place without warming these fluids so that they remain preferably at cryogenic temperatures.

In the case where the first unit included a mixing column, fluid from the second unit may be sent to the mixing column.

In all of the examples given for FIGS. 1 to 12, 15 and 16, it will be appreciated that the first unit could take any form of known air separation plant. It could for example be a single column with a top condenser and/or a bottom reboiler, a single column with at least one distillation tray or packing section above the top condenser wherein oxygen enriched liquid is fed to the top tray or the top of the packing section, a single column which is the high pressure column of a double column comprising a high pressure column or a low pressure column, a double column with any number of reboilers or condensers in the low pressure or high pressure column, a triple column with any number of reboilers or condensers in the low pressure, intermediate pressure or high pressure column, wherein the low pressure column is heated with gas from the top of the high and/or intermediate pressure column, any of the previously mentioned systems with an argon column or columns, krypton and xenon production column and/or at least one mixing column.

The products may be produced in liquid form or gaseous form being withdrawn in gaseous or liquid form from a column of the first and optionally second unit.

Vaporization of a liquid withdrawn from the first or second unit may take place in a heat exchanger of the first or second unit. In particular, a liquid withdrawn from the first unit may take place in a heat exchanger of the second unit and/or a liquid withdrawn from the second unit may take place in a heat exchanger of the first unit.

It will also be appreciated that the second unit could comprise two or more similar units working at different pressures both of which send fluid to and/or receive fluid from the first unit.

In the case of FIG. 2 there could for example be two or more wash columns 15 operating at different pressures.

We claim:

1. A process for increasing the amount of at least one product produced by a first unit for treating at least one fluid mixture by a method selected from the group consisting of pressurization, mixing in a mixing column, expansion, distillation, liquefaction, adsorption, permeation and combinations thereof, the method comprising sending at least one fluid mixture to the first unit and removing at least one product from the first unit, said product having a different composition from said at least one fluid mixture and optionally, at least one of a different state and a different pressure from said at least one fluid mixture, wherein the first unit alone before integrating a second unit to the first unit produces an amount A moles/h of a first product, the process comprising integrating the second unit with the first unit, said integration comprising sending at least one of (a) energy from the first unit to the second unit, (b) at lest one fluid stream from the first unit to the second unit, (c) energy from the second unit to the first unit and (d) at least one fluid stream from the second unit to the first unit, wherein said second unit treats at least one fluid mixture by a method selected from the group consisting of pressurization, expansion, warming, cooling, distillation, mixing, liquefaction, adsorption, permeation and combinations thereof such that the first unit produces an amount of first product A+B moles/h, said amount of first product withdrawn from the first unit and optionally from the second unit is increased to C moles/h, C being greater than A, and the amount C comprising at least one fluid stream withdrawn from the first unit and optionally from the second unit.

2. The process of claim 1, wherein the amount of the first product is increased such that A+B is less than or equal to C.

3. The process of claim 2, wherein the difference between C and A+B is an amount of product B' moles/h produced by the second unit.

4. The process of claim 1, wherein the percentage of a principal component in the first product in amount A and amount C differs by up to 5 mol. %.

5. The process of claim 4, wherein the percentage of the principal component in the first product in amount A and amount C differs by up to 1 mol. %.

6. The process of claim 5, wherein the percentage of the principal component in the first product in amount A and amount C differs by up to 0.2 mol. %.

7. The process of claim 1, wherein the percentage of a principal component in the first product in amount A and amount B' differs by up to 10 mol. %.

8. The process of claim 1, wherein the fluid mixture treated by the second unit has substantially the same composition as the fluid mixture treated by the first unit.

9. The process of claim 1, wherein the second unit produces a second product having at least one of a percentage of a principal component differing by 1 to 50% from the percentage of the first product of the first unit forming part of amount A+B, a different principal component, a different state and a different pressure from the first product of the first unit forming part of amount A+B.

10. The process of claim 1, wherein the amount of the fluid mixture in moles sent to the first unit for the production of amount A only is less than the amount of the fluid mixture in moles sent to the first unit for the production of amount C.

11. The process of claim 1, wherein the amount of the fluid mixture in moles sent to the first unit for the production of amount A only is less than the amount of the fluid mixture in moles sent to the first and second units for the production of amount C.

12. The process of claim 1, wherein the proportional increase in amount of the fluid mixture in moles sent to the first unit for the production of amount C following the addition of the second unit as compared with the production of amount of the fluid mixture in moles sent to the first unit for the production of amount A prior to the addition of the second unit is less than, equal to or greater than the proportional increase between amount C and amount A.

13. The process of claim 1, wherein the fluid mixture treated by the first and second units is:

i) substantially air and the first product contains at least 70 mol. % oxygen or at least 90 mol. % nitrogen or at least 90 mol. % argon or ii) a mixture comprising at least one of 1 mol. % nitrogen, at least 1 mol. % hydrogen, at least 1 mol. % carbon monoxide and at least 1 mol. % methane and the first product contains at least 90 mol. % nitrogen or at least 90 mol. % hydrogen or at least 90 mol. % carbon monoxide or at least 90 mol. % methane.

14. The process of claim 1, wherein the second unit does not treat the same fluid mixture as the first unit.

15. The process of claim 1, wherein at least one of the first unit and the second unit treat the fluid mixture or mixtures by cryogenic distillation or liquefaction.

16. The process of claim 1, wherein the first unit comprises at least one column, the process comprising removing at least one liquid from the at least one column and vaporizing the liquid to form at least part of the first product and withdrawing from the first unit in gaseous form.

17. The process of claim 1, wherein the second unit comprises means for modifying the composition of the at least one fluid mixture fed thereto, by a method selected from the group consisting of distillation, mixing in a mixing column, adsorption and permeation.

18. The process of claim 1, wherein at least one product of the second unit is not mixed with the first product of the first unit which is to be produced in increased quantities.

19. The process of claim 1, further comprising sending at least one fluid from the second unit to the first unit as a feed stream and subjecting the feed stream to at least one of separation and treatment within the first unit.

20. The process of claim 19, wherein the at least one fluid sent from the second unit to the first unit is richer in a principal component of the first product than the fluid mixture sent to at least one of the first unit and the second unit or the first product.

21. The process of claim 20, wherein the fluid sent from the second unit to the first unit is richer in the principal component of the first product than the fluid mixture sent to at least one of the first unit and the second unit but less rich in the principal component of the first product than the first product.

22. The process of claim 1, further comprising sending at least one fluid from the first unit to the second unit as a feed stream and subjecting the feed stream to at least one of separation and treatment within the second unit.

23. The process of claim 22, wherein the at least one fluid sent from the first unit to the second unit is less rich in a principal component of the first product than the fluid mixture sent to at least one of the first unit and the second unit or the first product.

24. The process of claim 22, wherein the at least one fluid sent from the second unit to the first unit is richer in the principal component of the first product than the fluid mixture sent to at least one of the first unit and the second unit but less rich in the principal component of the first product than the first product.

25. The process of claim 1, further comprising removing at least one fluid from the first unit less rich in a principal component of the first product than the at least one fluid stream sent from the second unit to the first unit.

26. The process of claim 24, wherein the at least one fluid sent from the second unit to the first unit contains at least 10% less of the principal component of the first product than the first product removed from the first unit.

27. The process of claim 25, further comprising sending the at least one fluid removed from the first unit to the second unit.

28. The process of claim 1, further comprising sending a fluid from the second unit to the first unit to provide additional reboil in the first unit.

29. The process of claim 1, further comprising sending a fluid from the second unit to the first unit to provide additional condensation in the first unit.

30. The process of claim 1, wherein the second unit does not produce a product.

31. The process of claim 1, wherein the second unit produces energy and the first unit does not produce energy.

32. The process of claim 1, wherein the first unit produces part A+B of the first product and the second unit produces the rest B' of the first product, the parts of the first product from the first and second units having a common principal component that differ by at least one of at most 5 bar and 20% of the pressure of the higher pressure stream.

33. The process of claim 1, wherein the first unit produces part A+B of the first product and the second unit produces the rest B' of the first product, the parts of the first product having a common principal component and the parts of the first product are in different physical states.

34. The process of claim 1, wherein the first unit produces at least one first product and the second unit produces at least one second product and the second product streams do not have the same principal component as the first product stream.

35. The process of claim 1, wherein the amount of the fluid stream sent from the first unit to the second unit in moles/h is substantially equal to the amount of the fluid stream sent from the second unit to the first unit in moles/h or differs from that amount by no more than 50%.

36. The process of claim 35, wherein the amount of the fluid stream sent from the first unit to the second unit in $m^3/h$ is substantially equal to the amount of the fluid stream sent from the second unit to the first unit in $m^3/h$ or differs from that amount by no more than 50%.

37. The process of claim 1, wherein the first unit comprises an air separation unit producing at least one fluid enriched in a component, wherein air is sent to the first unit and at least one fluid enriched in a component of air is removed from the first unit as a first product, an amount A moles/h of the first product being removed prior to the integration of a second unit and by sending at least one of (a) energy from the first unit to the second unit, (b) at least one fluid from first unit to the second unit, (c) energy from the second unit to the first unit and (d) at least one fluid from the second unit to the first unit, the amount of the first product which is produced by the first unit increases to A+B moles/h, wherein said second unit treats at least one gaseous mixture containing oxygen and nitrogen by a method selected from the group consisting of pressurization, expansion, warming, cooling, distillation, mixing in a mixing column, liquefaction, adsorption, permeation and combinations thereof such that the amount of fluid enriched in a component of air produced by the first unit and optionally by the second unit as said first product is increased to C moles/h, where C is greater than A.

38. The process of claim 37, wherein the first unit produces at least one first product and the second unit produces at least one second product and at least one second product has the same principal component as the at least one first product stream by the percentage of the principal component contained in the first and second product streams having a common principal component differs by at least 5 mol. % where the common principal component is oxygen or argon or the amount of minor components in moles differs by at least a multiple of 10 where the common principal component is nitrogen.

39. The process of claim 37, wherein the percentage of a principal component contained in the first and second product streams having a common principal component differs by at least 10 mol. % where the common principal component is oxygen or argon.

40. The process of claim 39, wherein the percentage of the principal component contained in the first and second product streams having a common principal component differs by at least 20 mol. % where the common principal component is oxygen or argon.

41. The process of claim 37, wherein the amounts of first product A and C or A and A+B have the same principal component and the amount of minor component is between amounts A and C or amounts A and A+B multiplied by at most a factor of 1.2.

42. The process of claim 37, wherein the amounts of first product A and C or A and A+B have the same principal component which is nitrogen and the amount of minor components in moles in A and C or A and A+B is multiplied by at most a factor of 10.

43. The process of claim 37 for separating air by cryogenic distillation comprising sending compressed and cooled air to at least one first distillation column of the first air separation unit comprising at least one column and removing oxygen enriched fluid and nitrogen enriched fluid from the first unit and sending compressed and cooled air to the second unit comprising at least a single column having at least a top condenser, at least partially condensing nitrogen enriched gas at the top of the single column of the second unit in the condenser, removing nitrogen enriched fluid from the second unit, removing oxygen enriched liquid from the single column and sending the oxygen enriched liquid to the top condenser to form vaporized oxygen enriched liquid and sending at least one of vaporized oxygen enriched liquid and unvaporized oxygen enriched oxygen from the single column to at least one column of the first air separation unit and withdrawing oxygen enriched fluid at least from the first air separation unit as a product.

44. The process of claim 43, wherein the first air separation unit comprises at least two distillation columns and said first distillation column is the column operating at the higher or highest pressure and the oxygen enriched product is removed from a column operating at a lower or the same pressure.

45. The process of claim 43, further comprising sending at least one of said vaporized oxygen enriched liquid and said unvaporized oxygen enriched liquid from the second unit to the first unit to be subjected to at least one of distillation and treatment.

46. The process of claim 45, further comprising sending at least one of said vaporized and said unvaporized oxygen enriched liquid to at least the first distillation column of the first air separation unit.

47. The process of claim 43, wherein said vaporized oxygen enriched liquid is sent to the condenser of an argon column, to a low pressure column or to a mixing column.

48. The process of claim 43, wherein the air sent to the second unit is at a higher pressure than, a lower pressure than or the same pressure as the highest pressure of any air stream sent to the first unit.

49. The process of claim 43, further comprising expanding at least part of the nitrogen enriched gas removed from the second column in a turbine.

50. The process of claim 43, further comprising removing product nitrogen from the second unit.

51. The process of claim 37 for increasing the capacity of the first air separation unit in which a first air stream is separated by cryogenic distillation in the first air separation unit from which an oxygen enriched fluid is removed comprising adding the second unit to the first unit, sending a second air stream air to the bottom of a column of the second unit, sending a nitrogen enriched liquid stream from the first air separation unit to the column of the second unit, removing a gaseous nitrogen stream from the top of the column of the second unit, sending an oxygen enriched fluid stream from the column of the second unit to the first unit and removing an increased amount of the oxygen enriched fluid from the first unit.

52. The process of claim 51, wherein said column of the second unit is a single column having no bottom reboiler and no top condenser.

53. The process of claim 51, further comprising sending air from a second compressor to the second unit and optionally to the first unit.

54. The process of claim 51, further comprising pressurizing or expanding the nitrogen enriched liquid from the first unit, and sending the nitrogen enriched liquid to the top of the column of the second unit.

55. The process of claim 51, wherein the column of the second unit operates at between 1.2 and 25 bar.

56. The process of claim 51, wherein the oxygen enriched liquid at the bottom of the column of the second unit contains between 25% and 50 mol. % oxygen.

57. The process of claim 51, wherein the first air separation unit comprises at least a double column comprising a high pressure column and a low pressure column and the nitrogen enriched liquid comes from at least one of the high pressure column and the low pressure column.

58. The process of claim 51, further comprising sending the fluid from the bottom of the column of the second unit to the bottom of the high pressure column or to the low pressure column.

59. The process of claim 51, further comprising removing a first product stream containing at least 80 mol. % oxygen from the low pressure column of the first unit.

60. The process of claim 51, wherein the first air separation unit is a triple column comprising a high pressure column, an intermediate pressure column or mixing column and a low pressure column and the nitrogen enriched liquid is sent from the high pressure column or the intermediate pressure column to the second unit.

61. The process of claim 60, further comprising removing a stream containing at least 80% oxygen from the low pressure column.

62. The process of claim 51, further comprising sending the fluid from at least one of the bottom of the further column and the top condenser to the high pressure column or the intermediate pressure column.

63. The process of claim 51, wherein the pressure of the higher or highest pressure column of the first air separation unit is between 4 and 25 bar.

64. The process of claim 37, wherein the first air separation unit produces an amount A of an oxygen enriched product stream as first product, the second unit comprising a mixing column is integrated with the first unit and, subsequently, oxygen enriched liquid is sent from the first unit to the top of the mixing column, a gas more volatile than the oxygen enriched liquid is sent to the bottom of the mixing column and a fluid enriched in oxygen is sent from the mixing column to the first unit.

65. The process of claim 64, wherein the fluid enriched in oxygen sent from the mixing column to the first unit is a heating stream for a condenser of a column of the first unit.

66. The process of claim 64, wherein the fluid enriched in oxygen is sent to a column of the first unit as a feed stream.

67. The process of claim 64, wherein the gas more volatile than the oxygen enriched liquid is air or vaporized oxygen enriched liquid from the bottom of the high pressure column of the double column which constitutes the first unit.

68. The process of claim 1, wherein the first unit is a liquefier comprising means for compressing a fluid and means for cooling and liquefying the compressed fluid and the second unit comprises a compressor connected in parallel with at least part of the means of compressing the fluid.

69. The process of claim 1, wherein at least part of the increased amount of first product A+B is treated in an element of the second unit.

70. An air separation apparatus having a first unit comprising at least a high pressure column and a low pressure column and optionally at least one of an intermediate pressure column and a mixing column, which are thermally linked, means for producing a stream containing more than 20 mol. % oxygen from a second unit including means for cryogenic distillation of air, means for sending at least part of the stream containing more than 20 mol. % oxygen to at least one of (a) the high pressure column, (b) the low pressure column, (c) the intermediate pressure column and (d) the mixing column, means for sending cooled and purified air at least to the high pressure column and to the second unit and means for removing an oxygen enriched product from at least one unit of the apparatus.

71. The apparatus of claim 70, wherein the second unit comprises a single column with a top condenser, means for feeding cooled and purified air to the single column and means for sending a fluid from the column to the top condenser and wherein the means for producing a stream containing more than 20 mol. % oxygen is connected to at least one of the top condenser and the single column and a column of the first unit.

72. The apparatus of claim 71, wherein conduit means are connected to the top condenser of the second unit so as to remove at least one of a liquid and a gas containing at least 20% oxygen therefrom and is connected to at least one of the high pressure column and the low pressure column of the first unit.

73. The apparatus of claim 70, further comprising means for removing at least one nitrogen enriched fluid from the single column.

74. The apparatus of claim 70, further comprising means for removing an oxygen enriched stream from the low pressure column of the first unit and vaporizing the oxygen enriched liquid so as to form the gaseous oxygen enriched product.

75. The apparatus of claim 70, further comprising means for sending the stream containing more than 20 mol. % oxygen to at least one of (a) the pressure column, (b) the high intermediate pressure column and (c) the low pressure column of the first unit, said means being connected downstream of a heat exchanger of the first unit wherein air to be distilled in the high pressure column is cooled to a temperature suitable for distillation.

76. The apparatus of claim 70, further comprising means for sending nitrogen enriched fluid from at least one of the first unit to the second unit and from the second unit to the first unit.

77. The apparatus of claim 70, further comprising means for sending at least one fluid from the first unit to the second unit and means for expanding or compressing the fluid from the first unit within the second unit.

78. The apparatus of claim 70, further comprising means for sending at least one liquid from the first unit to the second unit and means for vaporizing the fluid from the first unit within the second unit.

* * * * *

UNITED STATES PATENT AND TRADEMARK OFFICE
Certificate

Patent No. 6,666,048 B1 Patented: December 23, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jean-Renaud Brugerolle, Paris (FR); Alain Guillard, Paris (FR); Bernard Saulnier, Colombes (FR); Patrick Le Bot, Vincennes (FR); Jean-Marc Tsevery, Lieusaint (FR); Alain Fossier, Sceaux (FR); Jean-Luc Bretesche, Saint-Maur (FR); Bernard Darredeau, Sartrouville (FR); Frédêric Judas, Chatenay-Malabry (FR).

Signed and Sealed this Twenty-first Day of August 2007.

CHERYL J. TYLER
*Supervisory Patent Examiner*
Art Unit 3744